US006142618A

United States Patent [19]

Smith et al.

[11] Patent Number: 6,142,618

[45] Date of Patent: Nov. 7, 2000

[54] SYSTEM FOR DEPOSITING IMAGE ENHANCING FLUID AND INK JET PRINTING PROCESS EMPLOYING SAID SYSTEM

[75] Inventors: Thomas W. Smith, Penfield; Samuel Kaplan, Walworth; Kathleen M. McGrane, Webster; David J. Luca, Rochester; John S. Facci; Michael J. Levy, both of Webster, all of N.Y.

[73] Assignee: Xerox Corporation, Stamford, Conn.

[21] Appl. No.: 09/069,110

[22] Filed: Apr. 29, 1998

[51] Int. Cl.[7] ..... B41J 2/175

[52] U.S. Cl. ..... 347/85

[58] Field of Search ..... 347/84, 85, 86, 347/87, 96, 98, 100, 101; 399/174

[56] References Cited

U.S. PATENT DOCUMENTS

| | | | |
|---|---|---|---|
| 5,380,769 | 1/1995 | Titterington et al. | 523/161 |
| 5,428,384 | 6/1995 | Richtsmeier et al. | 347/102 |
| 5,457,523 | 10/1995 | Facci et al. | 355/219 |
| 5,561,505 | 10/1996 | Lewis | 355/219 |
| 5,602,626 | 2/1997 | Facci et al. | 399/135 |
| 5,644,350 | 7/1997 | Ando et al. | 347/101 |
| 5,895,148 | 4/1999 | Levy et al. | 399/174 |

FOREIGN PATENT DOCUMENTS

| | | | |
|---|---|---|---|
| 63-299971 | 12/1988 | Japan | B41M 5/00 |

*Primary Examiner*—N. Le
*Assistant Examiner*—Anh T. N. Vo
*Attorney, Agent, or Firm*—Judith L. Byorick

[57] ABSTRACT

Disclosed is a fluid deposition apparatus comprising (a) a fluid supply, (b) a porous fluid distribution member in operative connection with the fluid supply, enabling wetting of the fluid distribution member with a fluid, and (c) a porous metering membrane situated on the fluid distribution member, whereby the metering membrane enables uniform metering of the fluid from the fluid distribution member onto a substrate.

21 Claims, 2 Drawing Sheets

SYSTEM FOR DEPOSITING IMAGE ENHANCING FLUID AND INK JET PRINTING PROCESS EMPLOYING SAID SYSTEM

BACKGROUND OF THE INVENTION

The present invention is directed to printing processes. More specifically, the present invention is directed to printing processes, such as ink jet printing, wherein a fluid is applied to the print substrate either prior to or subsequent to application of the ink image with the printer. One embodiment of the present invention is directed to a fluid deposition apparatus comprising (a) a fluid supply, (b) a porous fluid distribution member in operative connection with the fluid supply, enabling wetting of the fluid distribution member with a fluid, and (c) a porous metering membrane situated on the fluid distribution member, whereby the metering membrane enables uniform metering of the fluid from the fluid distribution member onto a substrate.

Ink jet printing systems generally are of two types: continuous stream and drop-on-demand. In continuous stream ink jet systems, ink is emitted in a continuous stream under pressure through at least one orifice or nozzle. The stream is perturbed, causing it to break up into droplets at a fixed distance from the orifice. At the break-up point, the droplets are charged in accordance with digital data signals and passed through an electrostatic field which adjusts the trajectory of each droplet in order to direct it to a gutter for recirculation or a specific location on a recording medium. In drop-on-demand systems, a droplet is expelled from an orifice directly to a position on a recording medium in accordance with digital data signals. A droplet is not formed or expelled unless it is to be placed on the recording medium.

Since drop-on-demand systems require no ink recovery, charging, or deflection, the system is much simpler than the continuous stream type. There are three types of drop-on-demand ink jet systems. One type of drop-on-demand system has as its major components an ink filled channel or passageway having a nozzle on one end and a piezoelectric transducer near the other end to produce pressure pulses. The relatively large size of the transducer prevents close spacing of the nozzles, and physical limitations of the transducer result in low ink drop velocity. Low drop velocity seriously diminishes tolerances for drop velocity variation and directionality, thus impacting the system's ability to produce high quality copies. Drop-on-demand systems which use piezoelectric devices to expel the droplets also suffer the disadvantage of a slow printing speed.

Another type of drop-on-demand system is known as acoustic ink printing. As is known, an acoustic beam exerts a radiation pressure against objects upon which it impinges. Thus, when an acoustic beam impinges on a free surface (i.e., liquid/air interface) of a pool of liquid from beneath, the radiation pressure which it exerts against the surface of the pool may reach a sufficiently high level to release individual droplets of liquid from the pool, despite the restraining force of surface tension. Focusing the beam on or near the surface of the pool intensifies the radiation pressure it exerts for a given amount of input power. These principles have been applied to prior ink jet and acoustic printing proposals. For example, K. A. Krause, "Focusing Ink Jet Head," *IBM Technical Disclosure Bulletin*, Vol 16, No. 4, September 1973, pp. 1168–1170, the disclosure of which is totally incorporated herein by reference, describes an ink jet in which an acoustic beam emanating from a concave surface and confined by a conical aperture was used to propel ink droplets out through a small ejection orifice. Acoustic ink printers typically comprise one or more acoustic radiators for illuminating the free surface of a pool of liquid ink with respective acoustic beams. Each of these beams usually is brought to focus at or near the surface of the reservoir (i.e., the liquid/air interface). Furthermore, printing conventionally is performed by independently modulating the excitation of the acoustic radiators in accordance with the input data samples for the image that is to be printed. This modulation enables the radiation pressure which each of the beams exerts against the free ink surface to make brief, controlled excursions to a sufficiently high pressure level for overcoming the restraining force of surface tension. That, in turn, causes individual droplets of ink to be ejected from the free ink surface on demand at an adequate velocity to cause them to deposit in an image configuration on a nearby recording medium. The acoustic beam may be intensity modulated or focused/defocused to control the ejection timing, or an external source may be used to extract droplets from the acoustically excited liquid on the surface of the pool on demand. Regardless of the timing mechanism employed, the size of the ejected droplets is determined by the waist diameter of the focused acoustic beam. Acoustic ink printing is attractive because it does not require the nozzles or the small ejection orifices which have caused many of the reliability and pixel placement accuracy problems that conventional drop on demand and continuous stream ink jet printers have suffered. The size of the ejection orifice is a critical design parameter of an ink jet because it determines the size of the droplets of ink that the jet ejects. As a result, the size of the ejection orifice cannot be increased, without sacrificing resolution. Acoustic printing has increased intrinsic reliability because there are no nozzles to clog. As will be appreciated, the elimination of the clogged nozzle failure mode is especially relevant to the reliability of large arrays of ink ejectors, such as page width arrays comprising several thousand separate ejectors. Furthermore, small ejection orifices are avoided, so acoustic printing can be performed with a greater variety of inks than conventional ink jet printing, including inks having higher viscosities and inks containing pigments and other particulate components. It has been found that acoustic ink printers embodying printheads comprising acoustically illuminated spherical focusing lenses can print precisely positioned pixels (i.e., picture elements) at resolutions which are sufficient for high quality printing of relatively complex images. It has also has been discovered that the size of the individual pixels printed by such a printer can be varied over a significant range during operation, thereby accommodating, for example, the printing of variably shaded images. Furthermore, the known droplet ejector technology can be adapted to a variety of printhead configurations, including (1) single ejector embodiments for raster scan printing, (2) matrix configured ejector arrays for matrix printing, and (3) several different types of pagewidth ejector arrays, ranging from single row, sparse arrays for hybrid forms of parallel/serial printing to multiple row staggered arrays with individual ejectors for each of the pixel positions or addresses within a pagewidth image field (i.e., single ejector/pixel/line) for ordinary line printing. Inks suitable for acoustic ink jet printing typically are liquid at ambient temperatures (i.e., about 25° C.), but in other embodiments the ink is in a solid state at ambient temperatures and provision is made for liquefying the ink by heating or any other suitable method prior to introduction of the ink into the printhead. Images of two or more colors can be generated by several methods, including by processes wherein a single printhead launches acoustic waves into pools of different colored inks. Further information regarding acoustic ink jet printing apparatus and processes is disclosed in, for example, U.S. Pat. No. 4,308,547, U.S. Pat. No. 4,697,195, U.S. Pat. No. 5,028,937, U.S. Pat. No. 5,041,849, U.S. Pat. No. 4,751,529, U.S. Patent 4,751,530, U.S. Pat. No. 4,751,534, U.S. Pat. No. 4,801,953, and U.S. Pat. No. 4,797,693, the disclosures of each of which are totally incorporated herein by reference. The use of focused acoustic beams to eject droplets of controlled diameter and velocity from a free-liquid surface is also described in *J. Appl. Phys.*, vol. 65, no. 9 (1 May 1989) and references therein, the disclosure of which is totally incorporated herein by reference.

Still another type of drop-on-demand system is known as thermal ink jet, or bubble jet, and produces high velocity droplets and allows very close spacing of nozzles. The major components of this type of drop-on-demand system are an ink filled channel having a nozzle on one end and a heat generating resistor near the nozzle. Printing signals representing digital information originate an electric current pulse in a resistive layer within each ink passageway near the orifice or nozzle, causing the ink in the immediate vicinity to evaporate almost instantaneously and create a bubble. The ink at the orifice is forced out as a propelled droplet as the bubble expands. When the hydrodynamic motion of the ink stops, the process is ready to start all over again. With the introduction of a droplet ejection system based upon thermally generated bubbles, commonly referred to as the "bubble jet" system, the drop-on-demand ink jet printers provide simpler, lower cost devices than their continuous stream counterparts, and yet have substantially the same high speed printing capability.

The operating sequence of the bubble jet system begins with a current pulse through the resistive layer in the ink filled channel, the resistive layer being in close proximity to the orifice or nozzle for that channel. Heat is transferred from the resistor to the ink. The ink becomes superheated far above its normal boiling point, and for water based ink, finally reaches the critical temperature for bubble formation or nucleation of around 280° C. Once nucleated, the bubble or water vapor thermally isolates the ink from the heater and no further heat can be applied to the ink. This bubble expands until all the heat stored in the ink in excess of the normal boiling point diffuses away or is used to convert liquid to vapor, which removes heat due to heat of vaporization. The expansion of the bubble forces a droplet of ink out of the nozzle, and once the excess heat is removed, the bubble collapses on the resistor. At this point, the resistor is no longer being heated because the current pulse has passed and, concurrently with the bubble collapse, the droplet is propelled at a high rate of speed in a direction towards a recording medium. The resistive layer encounters a severe cavitational force by the collapse of the bubble, which tends to erode it. Subsequently, the ink channel refills by capillary action. This entire bubble formation and collapse sequence occurs in about 10 microseconds. The channel can be refired after 100 to 500 microseconds minimum dwell time to enable the channel to be refilled and to enable the dynamic refilling factors to become somewhat dampened. Thermal ink jet processes are well known and are described in, for example, U.S. Pat. No. 4,601,777, U.S. Pat. No. 4,251,824, U.S. Pat. No. 4,410,899, U.S. Pat. No. 4,412,224, and U.S. Pat. No. 4,532,530, the disclosures of each of which are totally incorporated herein by reference.

U.S. Pat. No. 5,380,769 (Titterington et al.), the disclosure of which is totally incorporated by reference, discloses reactive ink compositions that utilize at least two reactive components, a base ink component and a curing component, that are applied to a receiving substrate separately. The base ink component includes an ink carrier, a compatible colorant, and a crosslinkable constituent, and the curing component is a crosslinking agent. Upon exposure of the base ink component to the curing component, at least a portion of the ink is crosslinked to provide a printed image that is durable and abrasion resistant.

U.S. Pat. No. 5,428,384 (Richtsmeier et al.), the disclosure of which is totally incorporated herein by reference, discloses a color ink jet printer having a heating blower system for evaporating ink carriers from the print medium after ink jet printing. A preheat drive roller engages the medium and draws it to a print zone. The drive roller is heated and preheats the medium before it reaches the print zone. At the print zone, a print heater heats the underside of the medium via radiant and convective heat transfer through an opening pattern formed in a print zone heater screen. The amount of heat energy is variable, depending on the type of the print medium. A crossflow fan at the exit side of the print zone direct an airflow at the print zone in order to cause turbulence at the medium surface being printed and further accelerate evaporation of the ink carriers from the medium. An exhaust fan and duct system exhausts air and ink carrier vapor away from the print zone and out of the printer housing.

U.S. Pat. No. 5,457,523 (Facci et al.), the disclosure of which is totally incorporated herein by reference, discloses a device for applying an electrical charge to a charge retentive surface by transporting ions in a fluid media and transferring the ions to the member to be charged across the fluid media/charge retentive surface interface. The fluid media is positioned in contact with a charge retentive surface for depositing ions onto the charge retentive surface. In one specific embodiment, the fluid media is a ferrofluid material wherein a magnet is utilized to control the position of the fluid media, which, in turn, can be utilized selectively to control the activation of the charging process.

U.S. Pat. No. 5,602,626 (Facci et al.), the disclosure of which is totally incorporated herein by reference, discloses an apparatus for applying an electrical charge to a charge retentive surface by transporting ions through an ionically conductive liquid and transferring the ions to the member to be charged across the liquid/charge retentive surface interface. The ionically conductive liquid is contacted with the charge retentive surface for depositing ions onto the charge retentive surface via a wetted donor blade supported within a conductive housing, wherein the housing is coupled to an electrical power supply for applying an electrical potential to the ionically conductive liquid. In one specific embodiment, the charging apparatus includes a support blade for urging the donor blade into contact with the charge retentive surface and a wiping blade for wiping any liquid from the surface of the charge retentive surface as may have been transferred to the surface at the donor blade/charge retentive surface interface.

U.S. Pat. No. 5,561,505 (Lewis), the disclosure of which is totally incorporated herein by reference, discloses an apparatus for applying an electrical charge to a charge retentive surface by transporting ions through an ionically conductive liquid and transferring the ions to the member to be charged across the liquid/charge retentive surface interface. The tonically conductive liquid is contacted with the charge retentive surface for depositing ions onto the charge retentive surface via a wetted donor blade supported within a mechanically sealable housing adapted to permit movement of the wetted donor blade from an operative position in contact with the charge retentive surface, to a nonoperative position stored within the housing to prevent loss of the tonically conductive liquid in its liquid or vapor form so as to extend the functional life of the apparatus. In one specific embodiment, a wiper blade may be provided for removing any liquid droplets from the surface of the photoreceptor as may have been transferred at the donor blade/charge retentive surface interface.

Copending application U.S. Ser. No. 08/523,322, entitled "Segmented Flexible Heater for Drying a Printed Image," filed Aug. 30, 1995, with the named inventors Thomas F. Szlucha and John H. Looney, the disclosure of which is totally incorporated herein by reference, discloses a segmented flexible heater disposed adjacently to a paper path in a printing machine for heating a recording medium before printing and during printing. The segmented flexible heater includes a curved first portion for preheating the paper and a substantially planar second portion for heating the paper in a print zone wherein the second portion generates heat energy having a temperature greater than the heat energy generated by the first portion. The first portion includes apertures for accommodating drive rollers for moving the recording medium into the print zone area heated by the second portion. The apertures in the flexible heater provide for continuous heating of the recording medium before and during heating. The second portion is preferably at least two printing swaths wide to prevent thermal shock to the portion of the printing medium being printed on.

Copending application U.S. Serial No. 09/069,698, filed concurrently herewith, with the named inventors Joel A. Kubby, Lisa A. DeLouise, and David A. Mantell, the disclosure of which is totally incorporated herein by reference, discloses the processing of plain paper through a plain paper optimizer system prior to image formation on a recording surface. The optimizer system adds a fixing fluid during application of pressure and, optionally, heat to the paper surface. The surface contacted by the fixing fluid is enhanced, forming images of improved print quality. In one embodiment, plain paper is treated in an optimizer system, which comprises a heat and fuser assembly with silicone oil as the fixing fluid, and is transported into the print zone of an ink jet printer. Images printed on the treated surface demonstrate improvements in image quality manifested by reduction of both edge raggedness and intercolor bleeding.

Copending application U.S. Serial No. 09/069,111, filed concurrently herewith, with the named inventors Thomas W. Smith, Samuel Kaplan, Kathleen M. McGrane, and David J. Luca, the disclosure of which is totally incorporated herein by reference, discloses a process which comprises (a) applying to a substrate a fixing fluid which comprises a material selected from the group consisting of (1) block or graft copolymers of dialkylsiloxanes and polar, hydrophilic monomers capable of interacting with an ink colorant to cause the colorant to become complexed, laked, or mordanted, (2) organopolysiloxane copolymers having functional side groups capable of interacting with an ink colorant to cause the colorant to become complexed, laked, or mordanted, (3) perfluorinated polyalkoxy polymers, (4) perfluoroalkyl surfactants having thereon at least one group capable of interacting with an ink colorant to cause the colorant to become complexed, laked, or mordanted, and (5) mixtures thereof; (b) incorporating into an ink jet printing apparatus an ink composition which comprises water and a colorant which becomes complexed, laked, or mordanted upon contacting the fixing fluid; and (c) causing droplets of the ink composition to be ejected in an imagewise pattern onto the substrate.

While known compositions and processes are suitable for their intended purposes, a need remains for improved ink jet printing methods. In addition, a need remains for improved thermal ink jet printing processes. Further, a need remains for ink jet printing processes wherein the resulting images exhibit improved image permanence. Additionally, a need remains for ink jet printing processes wherein the resulting images exhibit improved waterfastness. There is also a need for ink jet printing processes wherein the resulting images have improved archival quality. In addition, there is a need for ink jet printing processes wherein the resulting images are bright and intense. Further, there is a need for ink jet printing processes wherein the image quality of the resulting prints is independent of the specific paper employed in the printing process. Additionally, there is a need for ink jet printing processes wherein the resulting images exhibit reduced wet smear. A need also remains for ink jet printing processes wherein the above noted advantages can be achieved at a reasonably low cost. In addition, a need remains for ink jet printing processes wherein the resulting images have sharp edges or boundaries and wherein ink feathering and intercolor bleed between adjacent colors is minimized. There is also a need for cost effective apparatus and processes for applying a fixing fluid to a substrate in an ink jet printer.

SUMMARY OF THE INVENTION

It is an object of the present invention to provide ink jet printing methods with the above noted advantages.

It is another object of the present invention to provide improved thermal ink jet printing processes.

It is yet another object of the present invention to provide ink jet printing processes wherein the resulting images exhibit improved image permanence.

It is still another object of the present invention to provide ink jet printing processes wherein the resulting images exhibit improved waterfastness.

Another object of the present invention is to provide ink jet printing processes wherein the resulting images have improved archival quality.

Yet another object of the present invention is to provide ink jet printing processes wherein the resulting images are bright and intense.

Still another object of the present invention is to provide ink jet printing processes wherein the image quality of the resulting prints is independent of the specific paper employed in the printing process.

It is another object of the present invention to provide ink jet printing processes wherein the resulting images exhibit reduced wet smear.

It is yet another object of the present invention to provide ink jet printing processes wherein the above noted advantages can be achieved at a reasonably low cost.

It is still another object of the present invention to provide ink jet printing processes wherein the resulting images have sharp edges or boundaries and wherein ink feathering and intercolor bleed between adjacent colors is minimized.

Another object of the present invention is to provide a cost effective apparatus and process for applying a fixing fluid to a substrate in an ink jet printer.

These and other objects of the present invention (or specific embodiments thereof) can be achieved by providing a fluid deposition apparatus comprising (a) a fluid supply, (b) a porous fluid distribution member in operative connection with the fluid supply, enabling wetting of the fluid distribution member with a fluid, and (c) a porous metering membrane situated on the fluid distribution member, whereby the metering membrane enables uniform metering of the fluid from the fluid distribution member onto a substrate.

DETAILED DESCRIPTION OF THE INVENTION

The present invention is directed to a process which entails incorporating an ink composition into an ink jet printing apparatus and causing droplets of the ink composition to be ejected in an imagewise pattern onto a substrate. In a particularly preferred embodiment, the printing apparatus employs a thermal ink jet process wherein the ink in the nozzles is selectively heated in an imagewise pattern, thereby causing droplets of the ink to be ejected in imagewise pattern.

Any suitable substrate can be employed. The advantages of the present invention are realized most specifically on porous or ink absorbent substrates, including plain papers, such as Xerox® 4024 papers, Xerox® Image Series papers, Courtland 4024 DP paper, ruled notebook paper, bond paper, and the like, and on fabrics. If desired, however, other substrates can be employed, including silica coated papers such as Sharp Company silica coated paper, JuJo paper, and the like, transparency materials, textile products, inorganic substrates such as metals and wood, and the like.

Prior to printing or after printing, a fixing fluid is applied to the substrate. When the fixing fluid is applied prior to printing, advantages such as enhancement of image quality (color gamut, edge acuity, and intercolor bleed) are often maximized. When the fixing fluid is applied after printing, advantages such as improved waterfastness, wet smear resistance, and image permanence are often maximized. The fixing fluid can be applied by any desired or suitable means. The fixing fluid includes a polymer which contains functional siloxane or perfluoroalkyl groups, and the fixing fluid can also be diluted with nonfunctional siloxane oils, perfluoroalkyl oils, or perfluorosiloxane oils; these materials have low surface energies and a propensity to spread uniformly across the surfaces of substrates such as paper. Typically, the fixing fluid is contained in a sump or reservoir, and can be applied to the substrate by any suitable or desired means, such as a roll, wicking system, blade, porous membrane, aerosol spray, or other metering method which either applies the fixing fluid directly to the substrate or applies the fixing fluid to another applicator means, such as a donor roll or the like.

Figure 1:
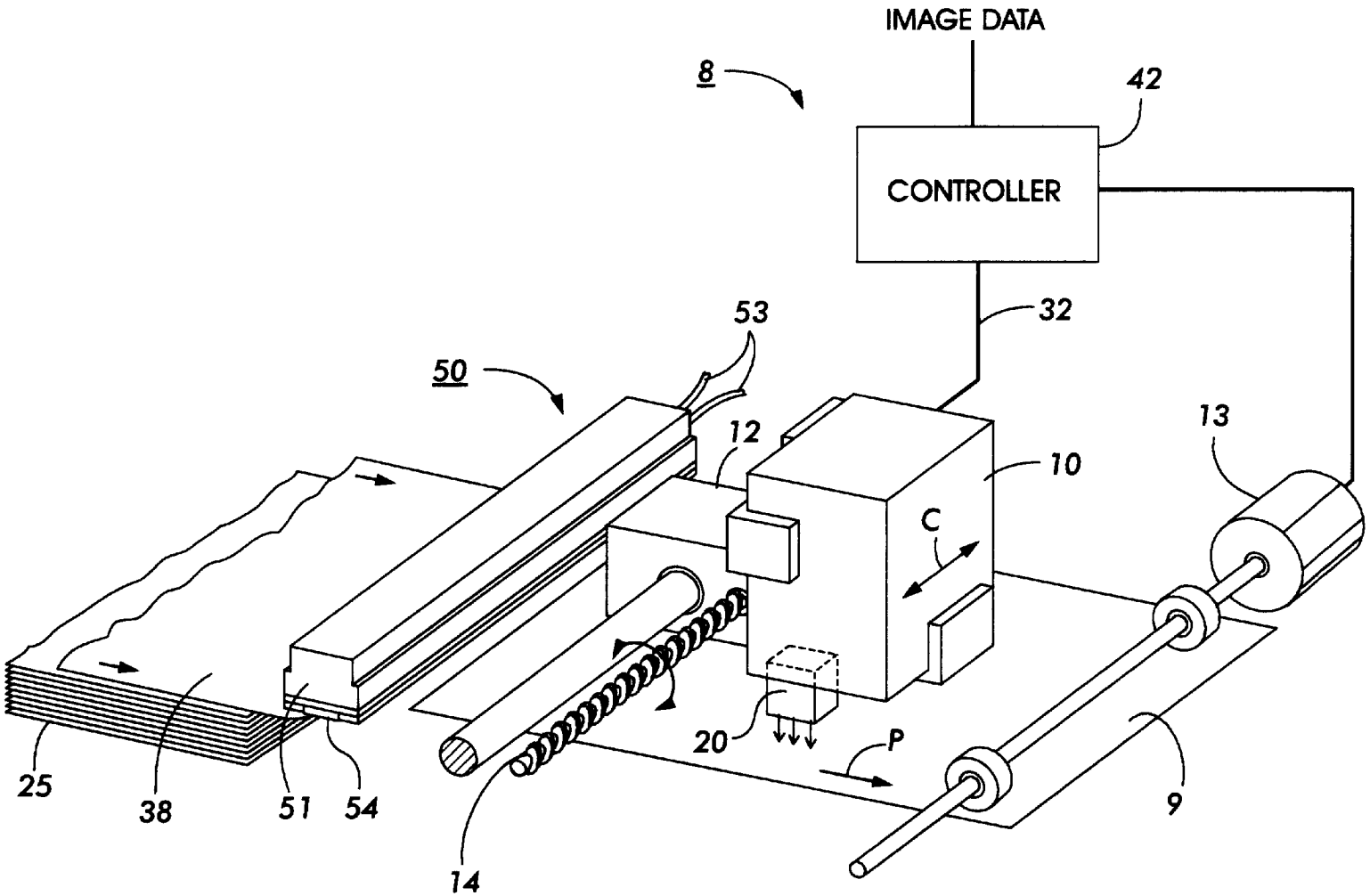
FIG. 1 is a schematic perspective view showing the basic elements of a reciprocating carriage type of thermal ink jet printer incorporating another fluid deposition assembly of the present invention.
Figure 2:
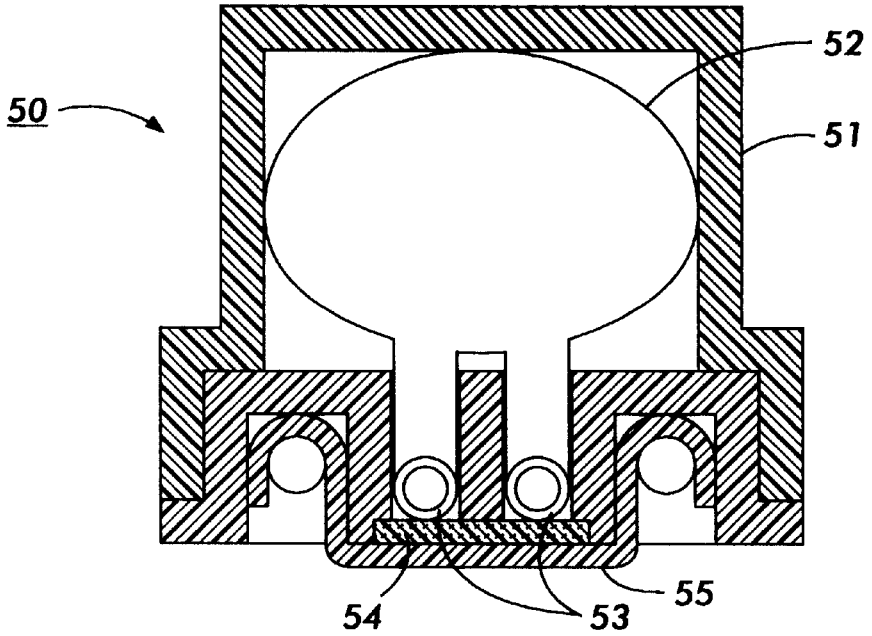
FIG. 2 is a schematic cross section view of one embodiment of a fluid deposition assembly of the present invention.
Figure 3:
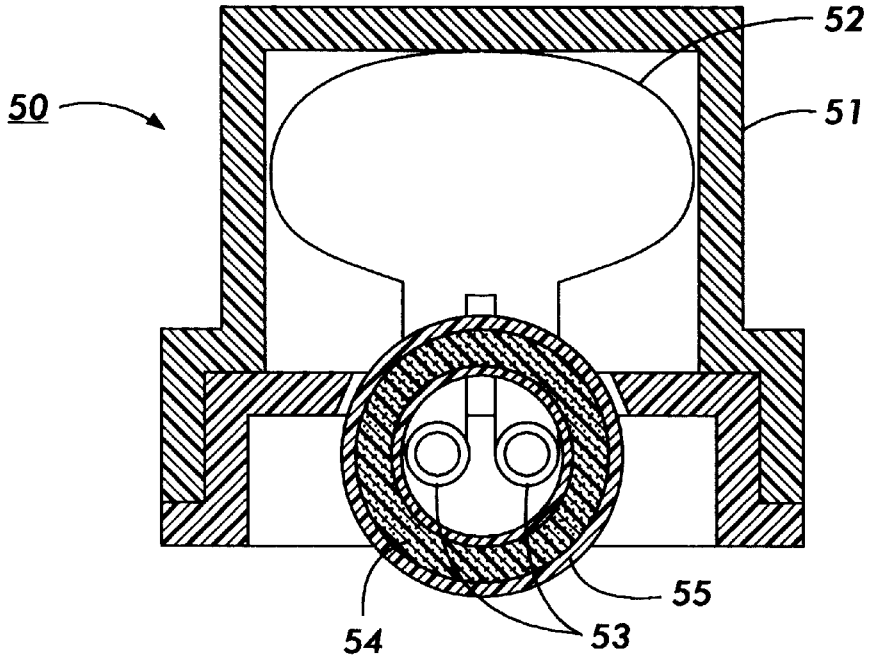
FIG. 3 is another schematic cross section view of one embodiment of a fluid deposition assembly of the present invention.

One example of a suitable apparatus for the process of the present invention is illustrated schematically in FIGS. 1 to 3. FIG. 1 shows the rudiments of a reciprocating carriage-type thermal ink jet printer 8 for creating color or monochrome images on a pre-treated substrate 9. Printer 8 is exemplary only. Other types of ink marking devices, such as piezoelectric ink jet printers, acoustic ink jet printers, multifunction printers, or the like can also be used. An ink cartridge 10, having a plurality of ink supplies therein, is preferably removably mounted on a carriage 12. This carriage 12 is adapted to move in a back-and-forth manner in direction C across substrate 9, which is moving in a process direction P. The substrate 9 is fed from a supply 25 by conventional feeding means along a path and in direction P by means of a stepper motor or other indexing motor 13, which is preferably adapted to cause the motion of substrate 9 in direction P in a stepwise fashion, holding the substrate 9 in a stationary position while the cartridge 10 moves across the substrate in direction C, and then indexing the substrate 9 in processing direction P between swaths of printing caused by the action of cartridge 10 being carried on carriage 12.

Carriage 12 is provided with one of various possible means for moving the cartridge 10 back and forth across substrate 9. As shown in FIG. 1, a rotatable lead screw 14 is provided having threads thereon which interact with a structure on the carriage 12 so that, when lead screw 14 is caused to rotate by a motor (not shown), the interaction of the lead screw threads with the structure on carriage 12 will cause the carriage 12 and the cartridge 10 mounted thereon to move in direction C across the substrate 9. Preferably, in most embodiments of an ink jet printer for use with the present invention, the carriage should be controlled to allow substantially even back-and-forth motion of the cartridge 10 so that the printing operation can be carried out in both directions. This may be accomplished, for example, by operatively attaching lead screw 14 to a bi-directional motor, or providing oppositely-wound sets of lead screw threads on lead screw 14 so that, once carriage 12 is moved to one side of the substrate 9, the structure on carriage 12 will re-engage with the opposite-wound threads on lead screw 14 to be moved in the opposite direction while the lead screw 14 is rotated in the same rotational direction.

Attached to cartridge 10, as shown in FIG. 1, is a printhead 20, which is shown directed downward toward the substrate 9. Printhead 20 comprises one or more linear arrays of thermal ink jet ejectors, each ejector being operatively connected to a particular ink supply. Generally, the linear array of ejectors in printhead 20 extends in a direction parallel to process direction P, so that, when the cartridge 10 is caused to move in carriage direction C, the linear array will "sweep" across the substrate 9 for an appreciable length, thus creating print swaths. While the carriage is moving across the substrate 9, the various ejectors in the linear array are operated to emit controlled quantities of ink of preselected colors in an image-wise fashion, thus creating the desired image on the substrate. Typical resolution of the ink jet ejectors in printhead 20 is from about 200 spots per inch to about 800 spots per inch, although the resolution can be outside of this range.

Also provided "upstream" of printhead 20 is a fluid deposition assembly 50. Fluid deposition assembly 50, illustrated schematically in cross section in more detail in FIGS. 2 and 3, is mounted in a simple housing 51 of any desired or suitable material, such as plastic or the like. The leading edge of substrate 9 enters into contact with fluid deposition 50 and is moved in direction P in combination with the movement provided by motor 13.

Operatively associated with the printer 8 is a controller 42. Controller 42 coordinates the "firing" of the various ejectors in the printhead 20 with the motion of cartridge 10 in carriage direction C, and with the process direction P of substrate 9, so that a desired image in accordance with the digital input image data is rendered in ink on the substrate 9. Image data in digital form is entered into controller 42, and controller 42 coordinates the position of the printhead 20 relative to substrate 9 to activate the various ejectors as needed, in a manner generally familiar to one skilled in the art of ink jet printing. Controller 42 will also control operation of motor 13, deposition assembly 50, and supply 25. Further details of the operation of a printer corresponding to printer 8 are found in U.S. Pat. No. 5,455,610, the disclosure of which is totally incorporated herein by reference.

As substrate 9 proceeds past the deposition assembly 50, it acquires a uniform, thin layer of the fixing fluid. As the substrate advances into the print zone, ink is projected from printhead 20 creating an image consisting of a plurality of print swaths. When the print operation is complete, substrate 9 is deposited in an output station (not shown), typically an output tray.

When the fixing fluid is applied to the substrate subsequent to printing, the process is similar, except that substrate 9 proceeds through deposition assembly 50 prior to passing through ink jet printer 8 (i.e., substrate 9 proceeds in a direction opposite to that of arrow "P").

Deposition assembly 50 includes a fixing fluid supply, either by a reservoir 52, which can be either rigid or conformable (such as a bladder reservoir), or by a fluid transporting structure 53, such as one or more umbilical tubes, made of any desired or suitable material, such as polyethylene or the like, a wicking system, or the like, through which fixing fluid can be fed into the system by, for example, gravity, capillary feed, or the like, or a combination thereof. At least one of reservoir 52 or transporting structure 53 is present. In embodiments wherein reservoir 52 is absent, transporting structure 53 supplies fixing fluid directly from an external source. In embodiments wherein transporting structure 53 is absent, reservoir 52 fully contains the fixing fluid inside of housing 51. In the embodiment wherein transporting structure 53 comprises umbilical tubes, the tubes are perforated or porous, and permit the fixing fluid to flow through the perforations onto fluid distribution member 54. When the umbilical tubes are supplied with fixing fluid by capillary feed, the perforations in the tube generally are substantially smaller in diameter than the diameter of the tube. Typically, perforations can be uniformly spaced at intervals of from about 1 to about 3 centimeters. In some embodiments, however, to maintain uniform feed rates, it may be preferred to increase the frequency of (or decrease the distance between) perforations as the fluid proceeds along the length of a capillary feed tube.

Illustrated schematically in FIG. 2 is one embodiment wherein fluid distribution member 54 is a stationary pad, of any desired or suitable wicking material, such as polyester felt, polyurethane foam, or the like. Illustrated schematically in FIG. 3 is another embodiment wherein fluid distribution member 54 is a hollow roller, of any desired or suitable wicking material, such as polyester felt, polyurethane, or the like. Suitable polyurethane foam sponges are commercially available from any of a number of manufacturers; Foamex International of Eddystone, Pa. is a supplier of a wide variety of polyurethane foams designed specifically for wicking and fluid delivery applications. In the region of fluid distribution member 54, the transporting structure 53, if of a generally solid material, such as an umbilical tube structure of polyethylene or the like, is perforated to enable uniform distribution of the fixing fluid across the surface of fluid distribution member 54. Fluid distribution member 54 is saturated with the fixing fluid. Situated in contact with fluid distribution member 54 and between fluid distribution member 54 and substrate 9 is metering membrane 55, which enables uniform metering of the fixing fluid from fluid distribution member 54 onto a substrate. Metering membrane 55 can be of any suitable or desired material, such as woven polyester, acrylic, cotton, silk, nylon, polypropylene fabric, or the like; one preferred metering membrane material is supplied by R. L. Gore Associates of Elkton, Md.

In the embodiment illustrated in FIG. 2, fluid distribution member 54 (in a pad configuration) and metering membrane 55 are of any desired width, and preferably are the width of the page to be coated with fixing fluid. In operation, metering membrane 55 is stationary with respect to fluid distribution member 54, fluid transporting structure 53, reservoir 52, and housing 51, and slides across the surface of substrate 9 to distribute fixing fluid thereon.

In the embodiment illustrated in FIG. 3, fluid distribution member 54 (in a roller configuration) and metering membrane 55 are of any desired width, and preferably are the width of the page to be coated with fixing fluid. In operation, metering membrane 55 is stationary with respect to fluid distribution member 54, both of which rotate with respect to fluid transporting structure 53, reservoir 52, and housing 51, and roll across the surface of substrate 9 to distribute fixing fluid thereon. The fluid distribution member typically rolls against a backing plate or another roller (not shown) to form a pressure nip through which the paper passes.

It has been found that pre-treatment of image receiving substrates with the fixing fluid improves image quality, particularly with respect to color intensity, feathering and edge acuity, intercolor bleed, image permanence, waterfastness, and wet smear. Pre-treatment also provides a level of substrate independence of image quality, so that image quality is substantially independent of the specific substrate (such as paper) used in the printing process. It has also been found that post-treatment of the printed substrate with the fixing fluid improves image color intensity, image permanence, waterfastness, and wet smear.

The fixing fluid used in the process of the present invention comprises a siloxane or perfluoro polymer or copolymer having functional groups thereon capable of interacting with the ink colorant. Interaction can be through hydrogen bonding, ion exchange, ion-dipole interaction, and/or other non-covalent bonding interactions such as apolar or hydrophobic bonding. The tendency of hydrocarbons or other nonpolar molecules to associate in aqueous solution is termed apolar (or hydrophobic) bond formation (Henry R. Mahler and Eugene H. Cordes, *Biological Chemistry,* 2nd Edition, p. 165, Harper & Row, New York). Accordingly, in aqueous solutions, associative interactions between hydrocarbon portions of a colorant and hydrocarbon portions of the siloxane polymer can be sufficient to effect binding. For the purposes of the present invention, the terms "polymer" and "copolymer" will be used to indicate species having repeat monomer units therein, including oils and oligomers. The functional moieties and segments in these polymers typically are ionophores (neutral nonionic functional groups which are capable of complexing with or binding ions, usually through ion-dipole bonds) or ionomers (polymers having ionic or ionizable sites covalently incorporated in the polymer chain). Complexing, mordanting, and laking mechanisms between ionophoric or ionomeric polymers and anionic or cationic dyes are disclosed in the context of xerographic toners in, for example, U.S. Pat. No. 5,434,030, the disclosure of which is totally incorporated herein by reference.

One class of suitable polymers for the fixing fluid is that of block or graft copolymers of dialkylsiloxanes and polar, hydrophilic monomers. The dialkylsiloxane portion of the block or graft copolymer typically is of the general formula

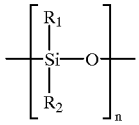

wherein n is an integer representing the number of repeat monomer units, $R_1$ and $R_2$ each, independently of the other, is an alkyl group, including linear, branched, cyclic, and unsaturated alkyl groups, typically with from 1 to about 22 carbons and preferably with from 1 to about 5 carbon atoms, although the number of carbon atoms can be outside of these ranges, an aryl group, typically with from 6 to about 12 carbon atoms, with 6 carbon atoms being preferred, although the number of carbon atoms can be outside of this range, or an arylalkyl group (with either the alkyl or the aryl portion of the group being attached to the silicon atom), typically with from 7 to about 28 carbon atoms, and preferably with from 7 to about 10 carbon atoms, although the number of carbon atoms can be outside of these ranges. The alkyl, aryl, or arylalkyl groups can, if desired, be substituted with substituents that do not significantly impair the ability of the polymer to spread uniformly across the paper surface, such as cyanopropyl groups, allyl groups, or the like. The functional portion of the polymer derived from polar, hydrophilic monomers and capable of interacting with the ink colorant typically is derived from monomers such as (1) alkylene oxides, including ethylene oxide, propylene oxide, and copolymeric sequences of ethylene oxide and propylene oxide, wherein the hydrophilic portion of the polymer is of the general formula

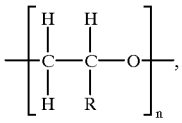

wherein R is hydrogen or methyl and n is an integer representing the number of repeat monomer units, (2) 2-alkyl oxazolines, wherein the hydrophilic portion of the polymer is of the general formula

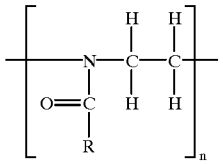

wherein n is an integer representing the number of repeat monomer units, R is an alkyl group, including linear, branched, cyclic, and unsaturated alkyl groups, typically with from 1 to about 22 carbons and preferably with from 1 to about 6 carbon atoms, although the number of carbon atoms can be outside of these ranges, an aryl group, typically with from 6 to about 12 carbon atoms, with 6 carbon atoms being preferred, although the number of carbon atoms can be outside of this range, or an arylalkyl group, typically with from 7 to about 28 carbon atoms, and preferably with from 7 to about 10 carbon atoms, although the number of carbon atoms can be outside of these ranges, (3) ethylene imine, wherein the hydrophilic portion of the polymer is of the general formula

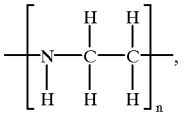

wherein n is an integer representing the number of repeat monomer units, (4) caprolactone, wherein the hydrophilic portion of the polymer is of the general formula

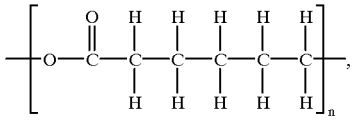

wherein n is an integer representing the number of repeat monomer units, (5) acrylic acid, wherein the hydrophilic portion of the polymer is of the general formula

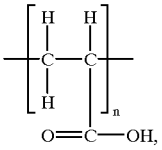

wherein n is an integer representing the number of repeat monomer units, (6) methacrylic acid, wherein the hydrophilic portion of the polymer is of the general formula

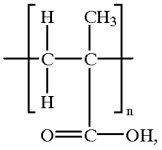

wherein n is an integer representing the number of repeat monomer units, (7) acrylate esters, such as acrylic esters and methacrylic esters, wherein the hydrophilic portion of the polymer is of the general formula

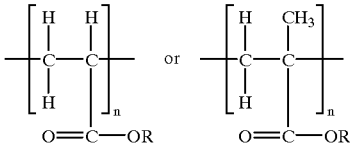

wherein n is an integer representing the number of repeat monomer units, R is an alkyl group, including linear, branched, cyclic, and unsaturated alkyl groups, typically with from 1 to about 22 carbons and preferably with from 1 to about 6 carbon atoms, although the number of carbon atoms can be outside of these ranges, an aryl group, typically with from 6 to about 12 carbon atoms, with 6 carbon atoms being preferred, although the number of carbon atoms can be outside of this range, or an arylalkyl group, typically with from 7 to about 28 carbon atoms, and preferably with from 7 to about 10 carbon atoms, although the number of carbon atoms can be outside of these ranges. These polymers typically contain the siloxane monomers in an amount of from about 50 to about 99 percent by weight of the polymer, preferably from about 75 to about 95 percent by weight of the polymer, and contain the polar, hydrophilic monomers in an amount of from about 1 to about 50 percent by weight of the polymer, preferably from about 5 to about 25 percent by weight of the polymer, although the relative amounts of monomers can be outside of these ranges. The number average molecular weight of the polymer typically is from about 1,000 to about 50,000, and preferably from about 2,000 to about 20,000, although the value can be outside of these ranges.

One specific example of a member of this class of block or graft copolymers of siloxane monomers and polar, hydrophilic monomers and capable of interacting with the ink colorant is that of siloxane-oxyalkylene polymers, including those of the general formula

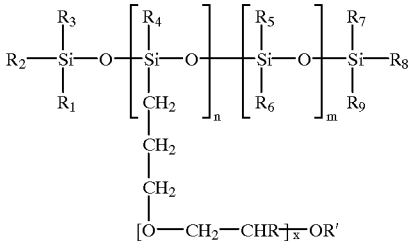

wherein R and $R^1$ each, independently of the other, is hydrogen or methyl, and $R_1$, $R_2$, $R_3$, $R_4$, $R_5$, $R_6$, $R_7$, $R_8$, and $R_9$ each, independently of the others, is an alkyl group, including linear, branched, cyclic, and unsaturated alkyl groups, typically with from 1 to about 22 carbons and preferably with from 1 to about 5 carbon atoms, although the number of carbon atoms can be outside of these ranges, an aryl group, typically with from 6 to about 12 carbon atoms, with 6 carbon atoms being preferred, although the number of carbon atoms can be outside of this range, or an arylalkyl group (with either the alkyl or the aryl portion of the group being attached to the silicon atom), typically with from 7 to about 28 carbon atoms, and preferably with from 7 to about 10 carbon atoms, although the number of carbon atoms can be outside of these ranges, and wherein the alkyl, aryl, or arylalkyl groups can, if desired, be substituted with substituents that do not significantly impair the ability of the polymer to form a uniform monolayer on a paper surface, such as cyanopropyl groups, halide groups, or the like, although substituents are not preferred, and m, n, and x are each integers representing the number of repeat monomer units. In a preferred embodiment, all of the R groups are methyl groups. In siloxane/oxyalkylene block and graft copolymers suitable for the present invention, x typically is an integer of from about 6 to about 30, and preferably from about 9 to about 20, although the value can be outside of these ranges. The relative molar ratio of n and m typically falls within the range of from about 3:97 to about 60:40, although the relative ratio can be outside of this range. Molecular weights of preferred materials typically are from about 600 to about 30,000 grams per mole, although the molecular weight can be outside of this range. Commercially available examples of this class of materials are the TEGOPREN®s, available from Goldschmidt Chemical, Hopewell, Va., such as TEGOPREN 5842, wherein x is 16 and the mole ratio of n to m is about 22:78; the DBE series of hydrophilic silicones available form Gelest, Inc., Tullytown, Pa.; the Silwet® silicone surfactant series available from Witco Corporation, OrganoSilicones Group, Greenwich, CT; Silicone Polyol copolymers available from Genesee Polymers Corporation, Flint, Mich.; and the like. Siloxane-oxyethylene block and graft copolymers typically are prepared by hydrosilylation of monoallyl or monovinyl ethers of polyethylene oxide glycols under the catalytic action of chloroplatinic acid by (Si—H) groups in dimethylsiloxane/methylhydrosiloxane copolymers, as disclosed in, for example, U.S. Pat. No. 2,486,458, the disclosure of which is totally incorporated herein by reference. The controlled synthesis of AB, ABA, and (AB)n type polyethylene oxide (A) and polydialkylsiloxane (B) copolymers by hydrosilylation of mono- or diallyl-terminated polyethylene oxide oligomers and telechelic (Si-H) terminated polydialkylsiloxane oligomers is also disclosed by, for example, Haesslin, *Makromol. Chem.,* 186, p. 357 (1985), the disclosure of which is totally incorporated herein by reference. Further information regarding the synthesis of such block and graft copolymers is also disclosed in, for example, U.S. Pat. No. 2,846,548; British Patent 983,850; British Patent 955,916; B. Kanner, B. Prokai, C. S. Eschbach, and G. J. Murphy, *J. Cellular Plast.*, November/December 315 (1979); H. W. Haesslin, H. F. Eicke and G. Riess, *Makromol. Chem.,* 185, 2625 (1984); M. Galin, A. Mathis, *Macromolecules,* 14, 677 (1981); and I. Yilgör and J. E. McGrath, "Polysiloxane-Containing Copolymers: A survey of Recent Developments," *Advances in Polymer Science*, Volume 86, pp. 1–86 (Springer-Verlag 1988), the disclosures of each of which are totally incorporated herein by reference.

Another class of suitable polymers for the fixing fluid is that of organopolysiloxane copolymers having functional side groups capable of interacting with the ink colorant, including those of the general formula

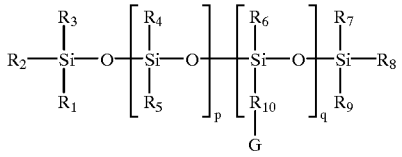

wherein $R_1$, $R_2$, $R_3$, $R_4$, $R_5$, $R_6$, $R_7$, $R_8$, and $R_9$ each, independently of the others, is an alkyl group, including linear, branched, cyclic, and unsaturated alkyl groups, typically with from 1 to about 22 carbons and preferably with from 1 to about 5 carbon atoms, although the number of carbon atoms can be outside of these ranges, an aryl group, typically with from 6 to about 12 carbon atoms, with 6 carbon atoms being preferred, although the number of carbon atoms can be outside of this range, or an arylalkyl group (with either the alkyl or the aryl portion of the group being attached to the silicon atom), typically with from 7 to about 28 carbon atoms, and preferably with from 7 to about 10 carbon atoms, although the number of carbon atoms can be outside of these ranges, and wherein the alkyl, aryl, or arylalkyl groups can, if desired, be substituted with substituents that do not significantly impair the ability of the polymer to form a uniform monolayer on a paper surface, such as cyanopropyl groups, halide groups, or the like, although substituents are not preferred, $R_{10}$ is a spacer group which is either an alkylene group, typically with from 2 to about 12 carbon atoms, and preferably with from 2 to about 6 carbon atoms, or an arylalkylene group wherein the alkyl portion is attached to the silicon atom and the aryl portion is attached to the "G" group, with the alkyl portion of the arylalkylene group typically having from 2 to about 12 carbon atoms, and preferably having from 2 to about 6 carbon atoms, and with the aryl portion of the arylalkylene group typically having 6 carbon atoms, p and q are each integers representing the number of repeat monomer units, and G is a functional group capable of interacting with the colorant and causing it to become complexed, laked, or mordanted, such as those of the formulae

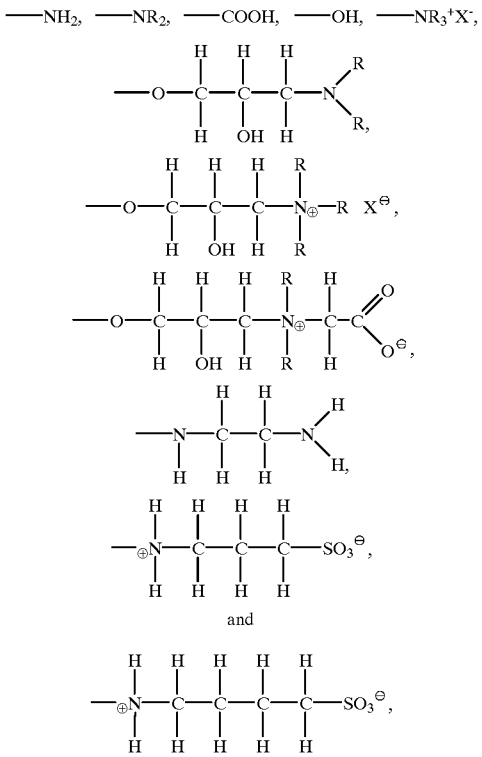

wherein X is an anion, including (but not limited to) halides, such as chloride, bromide, and iodide, nitrate, sulfate, sulfite, or the like, each R, independently of the others, is an alkyl group, including linear, branched, cyclic, substituted, and unsaturated alkyl groups, typically with from 1 to about 22 carbons and preferably with from 1 to about 7 carbon atoms, although the number of carbon atoms can be outside of these ranges. In a preferred embodiment, the R groups are all methyl groups. These polymers can be block copolymers, random copolymers, or alternating copolymers. Typically, the "p" monomers are present in the polymer in an amount of from 0 to about 99 mole percent, and preferably from about 50 to about 95 mole percent, and the "q" monomers are typically present in the polymer in an amount of from about 1 to 100 mole percent, and preferably from about 5 to about 50 mole percent, although the relative ratio of monomers can be outside of these ranges. The number average molecular weight of these polymers typically is from about 500 to about 30,000, and preferably from about 1,000 to about 5,000, although the value can be outside of these ranges.

One specific example of a member of this class of organopolysiloxane copolymers having functional side groups capable of interacting with the ink colorant is that of quaternary amino functionalized siloxane polymers, including those of the general formula

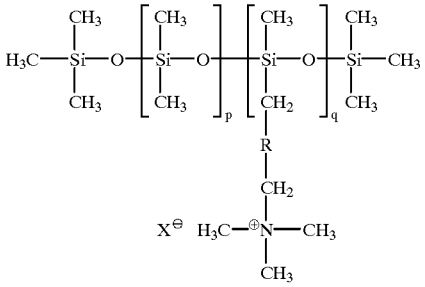

wherein p and q are each integers representing the number of repeat monomer units, X is an anion, and R is a methylene group or a benzyl group. A commercially available example of this class of materials is QMS-435, a hydrophilic silicone supplied by Gelest, Inc., Tullytown, Pa.

Another class of suitable polymers or oligomers for the fixing fluid are perfluodnated polyalkoxy polymers and perfluoroalkyl surfactants. This class includes anionic perfluoroalkyl surfactants, such as those of the formulae

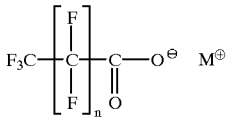

and

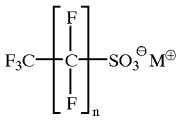

wherein n is an integer representing the number of repeat difluoromethyl units, and typically is 6 or 7, and M is a cation, such as an alkali metal ion, an ammonium ion, an alkylammonium ion, or the like. This class of materials also includes nonionic perfluorinated polyalkoxy surfactants, such as those of the formulae

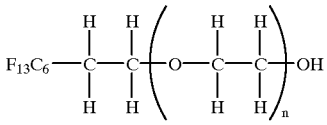

and

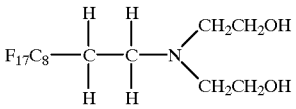

wherein n is an integer representing the number of repeat oxyethylene units, and typically is from 1 to about 20, although the value can be outside of this range. This class further includes nonionic perfluoroalkyl surfactants, such as those of the formula

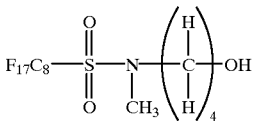

and the like. Specific examples of commercially available nonionic perfluorinated polyalkoxy polymers include KRYTOX® perfluorinated polyethers, typically with a molecular weight of from about 2,000 to about 7,000, including FS-17 and FS-19, available from E. I. du Pont de Nemours & Co., Wilmington, Del., and the like. Specific examples of commercially available suitable cationic and anionic perfluoroalkyl surfactants include the ZONYL® fluoroalkyls, such as FSA (carboxylic acid, lithium salt), FSB (betaine), FSC (tertiary amine quaternized, dimethylsulfate salt), FSP and FSJ (phosphate, ammonium salt). Specific examples of commercially available nonionic perfluoroalkyl surfactants include TLF-2967 (fluoroalkyl stearate), TLF-2981 (fluoroalkyl malonate), MPD-3689 (fluoroalkyl dodecanedioate), TLF-3641 (fluoroalkyl citrate), and BA (fluoroalcohol), available from E. I. du Pont de Nemours & Co., Wilmington, Del. Additional commercially available suitable fluorinated polymers and fluorinated surfactants include the FLUORAD® materials, such as FC 143 and FC I70C, available from 3M Company, St. Paul, Minn., the MONOFLOR® materials, such as 91, 53, 31, 73, and 32, available from ICI United States, Inc., Wilmington, Del., the LODYNE® materials, including those of the formula

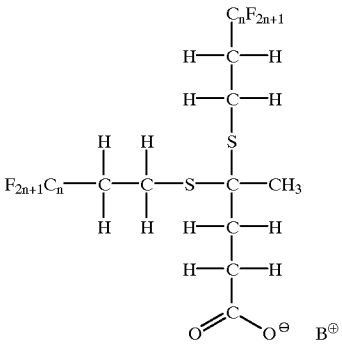

wherein n is an integer of from about 8 to about 20 and B is a cation, such as $(HO—CH_2CH_2)_2NH_2^+$, ammonium, $(HO—CH_2CH_2)_3NH^+$, $(HO—CH_2CH_2)NH_3^+$, an imidazolium cation such as imidazolium, N-methyl imidazolium, or N-butyl imidazolium, tris(hydroxymethyl)aminomethane hydrochloride, tris(hydroxymethyl)aminomethane hydrocitrate, protonated 1,4-diazabicyclo[2.2.2]octane, and the like, available from, for example, Ciba-Geigy, Ardsley, New York (Greensboro, N.C.) as LODYNE P-201, and those of the formula

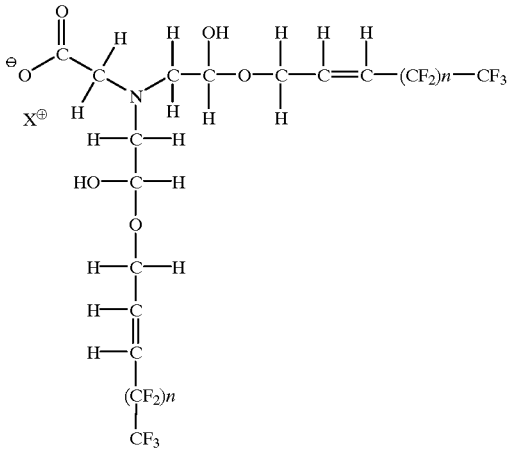

wherein n is an integer of from about 3 to about 20, preferably from about 4 to about 15, and more preferably from about 5 to about 11, and $X^+$ is a cation, such as ammonium, $(HO—CH_2CH_2)_2NH_2^+$, $(HO—CH_2CH_2)_3NH^+$, $(HO—CH_2CH_2)NH_3^+$, an imidazolium cation such as imidazolium, N-methyl imidazolium, or N-butyl imidazolium, tris(hydroxymethyl)aminomethane hydrochloride, tris(hydroxymethyl)aminomethane hydrocitrate, protonated 1,4-diazabicyclo[2.2.2]octane, and the like, available from, for example, Ciba-Geigy, Ardsley, N.Y. (Greensboro, N.C.) as LODYNE P-502.

The fixing fluid can also, if desired, contain a complexing agent. The effectiveness of many of the siloxanes and perfluorinated materials selected for the fixing fluid, particularly those containing polyethylene oxide chains, polyamines, and polyethyleneimines, can be augmented by complexation with reagents such as classical dye mordants, fixing agents, and the like which, upon contacting the colorant in the ink used to generate the image, cause the colorant to become incorporated in the polymer/complexing agent complex. Accordingly, the complexing agent and the colorant used in the ink can be selected to optimize the complementary reaction between the colorant and the fixing fluid.

For example, when an acid dye is used, the complexing agent can be a multivalent metal ion, such as magnesium ($Mg^{2+}$), calcium ($Ca^{2+}$), strontium ($Sr^{2+}$), barium ($Ba^{2+}$), manganese ($Mn^{2+}$), aluminum ($Al^{3+}$), zirconium ($Zr^{4+}$), or the like, as well as mixtures thereof. In addition, the complexing agent can be an ammonium ion, a benzylammonium ion, a alkylammonium ion, typically with from 1 to about 22 carbon atoms and preferably with from 1 to about 6 carbon atoms, such as an allylammonium ion, a methylammonium ion, an ethylammonium ion, or the like, or a polyalkylammonium ion. Any desired or suitable counterion or anion can be employed with a cationic complexing agent, with the specific anion selected to optimize solubility of the complexing agent in the fixing fluid and to optimize any interaction between the anion and the dye. Examples of suitable anions include, but are not limited to, halides, such as chloride, bromide, and iodide, acetate, triflate, tosylate, mesylate, hexafluorophosphate, tetrafluoborate, hexachloroantimonate, thiocyanate, and the like, as well as mixtures thereof.

When a basic dye is used, the complexing agent can be a heteropolyacid material such as phosphotungstic acid ($H_3PO_4 \cdot 12WO_3 \cdot XH_2O$) (wherein X is variable, with common values including (but not being limited to) 12, 24, or the like), silicotungstic acid ($SiO_2 \cdot 12WO_3 \cdot 26H_2O$), phosphomolybdic acid ($MoO_3 \cdot 20H_3PO_4 \cdot 48H_2O$), and the like, all commercially available from, for example, Aldrich Chemical Co., Milwaukee, Wis., as well as mixtures thereof. Also suitable are isopolyacids and their salts, such as molybdates, vanadates, tungstates, and the like, commercially available from, for example, Strem Chemicals, Inc., Newburyport, Mass., as well as mixtures thereof. Also suitable are di-, tri-, and tetracarboxylic acids, such as oxalic acid, pyromelletic tetracarboxylic acid, succinic acid, polyacrylic acid and its analogs, and the like, boric acid, borate anions ($B_{47}-$), tetraaryl boride anions, such as sodium tetraphenylboride, alkyl substituted aryl sulfonate anions, such as dodecyl benzene sulfonic acid, alkyl phosphate anions, such as tridecyl alcohol phosphate ester sodium salt, and the like, as well as mixtures thereof. Any desired or suitable counterion or cation can be employed with an anionic complexing agent, with the specific cation selected to optimize solubility of the complexing agent in the fixing fluid and to optimize any interaction between the cation and the dye. Examples of suitable cations include, but are not limited to, ammonium cations, tetraalkyl ammonium cations, such as tetramethylammonium hydroxide or the like, metal cations, such as alkali metal cations, alkaline earth cations, or the like, and the like, as well as mixtures thereof.

The complexing agent is complexed with the polymer selected for the fixing fluid by admixing the complexing agent with the polymer. In a preferred embodiment, the complexing agent is admixed with a solvent such as an alcohol, an ether such as THF, or the like, and admixed with the polymer with stirring to form a homogeneous solution or a colloidal solution of the resulting polymer/complexing agent complex. In a particularly preferred embodiment, when the complexing agent is acidic, such as phosphotungstic acid or the like, and the polymer selected for the fixing fluid is a siloxane polymer, the solution of complexing agent is neutralized with, for example, tetramethyl ammonium hydroxide, prior to admixing it with the polymer to avoid acid cleaving of the siloxane chain.

The polymer and the complexing agent are present with respect to each other in any desired or effective relative amounts in the fixing fluid. For example, when the complexing agent is a metal ion and the polymer in the fixing fluid contains ethylene oxide chains, typically, the fixing fluid contains from about 1 metal ion for every 100 ethylene oxide groups to about 1 metal ion for every 3 ethylene oxide groups, with about 1 metal ion for every 20 ethylene oxide groups being typical, although the relative amounts can be outside of these ranges. In general, the relative amounts of metal ion and polymer can be determined by the type of complex the metal forms. For example, most metals form hexacoordinated complexes with six ligands. In a polymer or functional group on a polymer, each hetero atom typically is the center of a single ligand. For instance, an ethylene oxide group ($CH_2CH_2O$), having one hetero atom, would represent a single ligand center, and six of these moieties could bind to a single hexacoordinating metal atom. Similarly, an ethyleneimine group ($CH_2CH_2NH$), also having one hetero atom, would also represent a single ligand center, and six of these moieties could bind to a single hexacoordinating metal atom. A carboxylic acid group, having two hetero atoms, would represent two ligand centers, and three of these moieties could bind to a single hexacoordinating metal atom. Typically, the complexing agent is added in an amount so that the binding capacity of the polymer is not exceeded; accordingly, it is preferred that no more than half of all possible polymer complexing sites are bound by the metal complexing agent. When the complexing agent is not a metal ion, typically the complexing agent is added to the polymer in the fixing fluid in an amount so that from about 10 to about 80 percent, and preferably from about 25 to about 75 percent, of the polymer groups capable of reacting with or complexing with the complexing agent are reacted with or complexed with the complexing agent, although the relative amounts can be outside of these ranges. In instances in which nonstoichiometric complexes are formed, such as is the instance when the polymer contains ethylene oxide chains and the complexing agent is a phosphotungstate, typically the polymer and the complexing agent are present in relative amounts of from about 5 percent by weight complexing agent and about 95 percent by weight polymer to about 50 percent by weight complexing agent and about 50 percent by weight polymer, although the relative amounts can be outside of this range.

The fixing fluid is applied to the substrate in any desired or effective amount. Typically, the fixing fluid is applied in an amount of from about 10 to about 200 microliters per 8.5 by 11 inch substrate surface coated (93.5 square inches), although the amount can be outside of these ranges. For example, on very light papers, amounts as low as 1 microliter per 8.5 by 11 inch substrate surface coated can be suitable, and on substrates such as tee shirt fabrics, amounts as high as 500 to 1,000 microliters per 8.5 by 11 inch substrate surface coated can be suitable.

Ink compositions suitable for the process of the present invention generally comprise an aqueous liquid vehicle and a colorant. The liquid vehicle can consist solely of water, or it can comprise a mixture of water and a water soluble or water miscible organic component, such as ethylene glycol, propylene glycol, diethylene glycols, glycerine, dipropylene glycols, polyethylene glycols, polypropylene glycols, amides, ethers, urea, substituted ureas, ethers, carboxylic acids and their salts, esters, alcohols, organosulfides, organosulfoxides, sulfones (such as sulfolane), alcohol derivatives, carbitol, butyl carbitol, cellusolve, tripropylene glycol monomethyl ether, ether derivatives, amino alcohols, ketones, N-methylpyrrolidinone, 2-pyrrolidinone, cyclohexylpyrrolidone, hydroxyethers, amides, sulfoxides, lactones, polyelectrolytes, methyl sulfonylethanol, imidazole, betaine, and other water soluble or water miscible materials, as well as mixtures thereof. When mixtures of water and water soluble or miscible organic liquids are selected as the liquid vehicle, the water to organic ratio typically ranges from about 100:0 to about 30:70, and preferably from about 97:3 to about 40:60. The non-water component of the liquid vehicle, which has a boiling point higher than that of water (100° C.), can serve as a humectant, penetrant, and/or dye solubilizing component. In the ink compositions of the present invention, the liquid vehicle is typically present in an amount of from about 80 to about 99.9 percent by weight of the ink, and preferably from about 90 to about 99 percent by weight of the ink, although the amount can be outside these ranges.

The inks of the present invention also contain a colorant. The colorant can be an anionic dye, such as an acid dye, a basic dye, or a reactive dye, a cationic dye, such as a basic dye, a neutral water-insoluble dye stabilized by surfactants or dispersing agents or cosolvents, such as a disperse dye or an oil soluble dye, or a pigment dispersion (including carbon black) ionically stabilized by adsorbed or bound anionic or cationic groups, adsorbed anionic or cationic surfactants, or sterically stabilized by nonionic surfactants.

Examples of suitable acid dyes include the Acid Black dyes (No. 1, 7, 9, 24, 26, 48, 52, 58, 60, 61, 63, 92, 107, 109, 118, 119, 131, 140, 155, 156, 172, 194, and the like), Acid Red dyes (No. 1, 8, 17, 32, 35, 37, 52, 57, 92, 115, 119, 154, 249, 254, 256, and the like), Acid Blue dyes (No. 1, 7, 9, 25, 40, 45, 62, 78, 80, 92, 102, 104, 113, 117, 127, 158, 175, 183,193, 209, and the like), Acid Yellow dyes (No. 3, 7, 17, 19, 23, 25, 29, 38, 42, 49, 59, 61, 72, 73, 114, 128, 151, 245, and the like), and the like. Specific examples include Pylam Certified D&C Red #28 (Acid Red 92), available from Pylam; Tartrazine Extra Conc. (FD&C Yellow #5, Acid Yellow 23), available from Sandoz; D&C Yellow #10 (Acid Yellow 3), available from Tricon; Pro-Jet® Magenta I (Acid Red 249), available from ICI; Duasyn® Acid Yellow XX-SF LP413 (Acid Yellow 23), available from Hoechst; Duasyn® Rhodamine B-SF VP353 (Acid Red 52), available from Hoechst; Duasyn® Acid Blue AE-SF VP344 (Acid Blue 9), available from Hoechst; and the like.

Examples of suitable basic dyes include the Basic Yellow dyes (No. 2, 17, 21, 51, and the like), Basic Red dyes (No. 1, 2, 5, 9, 29, and the like), Basic Blue dyes (No. 6, 7, 9, 11, 12, 16, 17, 24, 26, 41, 47, 66, and the like). Specific examples include Victoria Blue B (Basic Blue 26), Methyl Violet (Solvent Violet 8), Auramine 0 (Basic Yellow 2), Rhodamine 6G (Basic Red 1), and the like.

The dye is present in the ink in any desired or effective amount, typically from about 0.5 to about 15 percent by weight, preferably from about 1 to about 10 percent by weight, although the amount can be outside of these ranges.

Examples of suitable pigments include various carbon blacks such as channel blacks; furnace blacks; lamp blacks; Raven® carbon blacks including Raven® 5250, Raven® 5750, Raven® 3500 and other similar carbon black products available from Columbia Company; carbon blacks including Regal® 330, Black Pearl® L, Black Pearl® 1300, and other similar carbon black products available from Cabot Corporation; Degussa carbon blacks such as Color Black® series, Special Black® series, PrinttexO series and Derussol® carbon black dispersions available from Degussa Company; Cabojet® series carbon black dispersions including Cabot IJX 56 carbon black dispersion, Cabojet® 200, Cabojet® 300, and the like from Cabot corporation; Lavanyl® carbon black dispersions from Bayer Company, Special Black® carbon black dispersions from BASF Co.; Hostafine® series pigment dispersions such as Hostafine® Yellow GR (Pigment 13), Hostafine® Yellow (Pigment 83), Hostafine® Red FRLL (Pigment Red 9), Hostafine® Rubine F6B (Pigment 184), Hostafine® Blue 2G (Pigment Blue 15:3), Hostafine® Black T (Pigment Black 7, carbon black), and Hostafine® Black TS (Pigment Black 7), available from Hoechst/Celanese Corporation; Normandy Magenta RD-2400 (Paul Uhlich); Paliogen Violet 5100 (BASF); Paliogen® Violet 5890 (BASF) Permanent Violet VT2645 (Paul Uhlich); Heliogen Green L8730 (BASF); Argyle Green XP-1 11-S (Paul Uhlich); Brilliant Green Toner GR 0991 (Paul Uhlich); Heliogen® Blue L6900; L7020 (BASF), Hellogen® Blue D6840, D7080 (BASF); Sudan Blue OS (BASF); PV Fast Blue B2GO1 (Hoechst/Celanese); Irgalite Blue BCA (Ciba-Geigy); Paliogen® Blue 6470 (BASF); Sudan IIIl (Matheson, Coleman, Bell); Sudan II (Matheson, Coleman, Bell); Sudan IV (Matheson, Coleman, Bell); Sudan Orange G (Aldrich); Sudan Orange 220 (BASF); Paliogen® Orange 3040 (BASF); Ortho Orange OR 2673 (Paul Uhlich); Paliogen® Yellow 152,1560 (BASF); Lithol Fast Yellow 0991 K (BASF); Paliotol Yellow 1840 (BASF); Novoperm® Yellow FG 1 (Hoechst/Celanese); Permanent Yellow YE 0305 (Paul Uhlich); Lumogen Yellow D0790 (BASF); Suco-Gelb L1250 (BASF); Suco-Yellow D1355 (BASF); Hostaperm® Pink E (Hoechst/Celanese), Fanal Pink D4830 (BASF); Cinquasia Magenta (DuPont); Lithol Scarlet D3700 (BASF); Toluidine Red (Aldrich); Scarlet for Thermoplast NSD PS PA (Ugine Kuhlmann of Canada); E.D. Toluidine Red (Aldrich); Lithol Rubine Toner (Paul Uhlich); Lithol Scarlet 4440 (BASF); Bon Red C (Dominion Color Company); Royal Brilliant Red RD-8192 (Paul Uhlich); Oracet Pink RF (Ciba-Geigy); Paliogen® Red 3871 K (BASF); Paliogen® Red 3340 (BASF); Lithol Fast Scarlet L4300 (BASF); and the like, as well as mixtures thereof. The colorant can be present in the inks either with or without a dispersing agent. For example, pigment particles such as those modified chemically to possess ionizable functional groups in water, If such as carboxylate or sulfonate groups, are stable in an aqueous ink and do not require a dispersing agent. Some examples of chemically modified pigments are disclosed in, for example, U.S. Pat. No. 5,281,261, the disclosure of which is totally incorporated herein by reference. Pigment particles which are not chemically modified preferably are present with at least a dispersing agent (or dispersant) to stabilize the particles in an aqueous ink. Preferred average particle sizes or diameters are generally from about 0.001 to about 3 microns, although the particle sizes can be outside of these ranges. The pigment can be present in the ink in any effective amount. Typically the pigment is present in an amount of from about 0.1 to about 15 percent by weight of the ink, and preferably from about 1 to about 10 percent by weight of the ink, although the amount can be outside of these ranges.

Mixtures of two or more dyes and/or pigments can also be employed in the inks for the process of the present invention.

Other optional additives to the inks include biocides such as Dowicil 150, 200, and 75, benzoate salts, sorbate salts, and the like, present in an amount of from about 0.0001 to about 4 percent by weight of the ink, and preferably from about 0.01 to about 2.0 percent by weight of the ink, pH controlling agents, such as acids or bases, phosphate salts, carboxylates salts, sulfite salts, amine salts, and the like, present in an amount of from 0 to about 1 percent by weight of the ink and preferably from about 0.01 to about 1 percent by weight of the ink, or the like.

The ink compositions are generally of a viscosity suitable for use in thermal ink jet printing processes. At room temperature (i.e., about 250C), typically, the ink viscosity is no more than about 10 centipoise, and preferably is from about 1 to about 5 centipoise, more preferably from about 1 to about 4 centipoise, although the viscosity can be outside this range.

Ink compositions for the present invention can be of any suitable or desired pH. Typical pH values are from about 4 to about 10, and preferably from about 4 to about 8, although the pH can be outside of these ranges.

Ink compositions suitable for ink jet printing can be prepared by any suitable process. Typically, the inks are prepared by simple mixing of the ingredients. One process entails mixing all of the ink ingredients together and filtering the mixture to obtain an ink. Inks can be prepared by preparing a conventional ink composition according to any desired process, such as by mixing the ingredients, heating if desired, and filtering, followed by adding any desired additional additives to the mixture and mixing at room temperature with moderate shaking until a homogeneous mixture is obtained, typically from about 5 to about 10 minutes. Alternatively, the optional ink additives can be mixed with the other ink ingredients during the ink preparation process, which takes place according to any desired procedure, such as by mixing all the ingredients, heating if desired, and filtering.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

Preparation of Poly[Dimethylsiloxane-co-(3-Aminopropyl)Methyl Siloxane/3-Ammoniopropyl) Methyl Siloxane Triflate]

Poly[dimethylsiloxane-co-(3-aminopropyl) methyl siloxane/3-ammoniopropyl) methyl siloxane triflate] was prepared by fractionally neutralizing poly [dimethylsiloxane-co-(3-aminopropyl) methyl siloxane] (GP-4 silicone fluid, obtained from Genesee Polymers Corporation, Flint Mich.) with trifluoroacetic acid. Thus, 300 grams (0.244 equivalents) of GP-4 silicone fluid and 20.89 grams (0.1826 equivalents) of trifluoroacetic acid were combined and mixed in a 1000 milliliter glass beaker to yield a clear colorless liquid. The viscosity of the resulting material was about 1,355 centipoise.

Via procedures analogous to that described above, nonadecafluorodecanoic acid and nonafluoropentanoic acid were each reacted with poly[dimethylsiloxane-co-(3-aminopropyl) methyl siloxane] to yield, respectively, poly [dimethylsiloxane-co-(3-aminopropyl) methyl siloxane/3-ammoniopropyl) methylsiloxane nonadecafluorodecanoate] and poly[dimethylsiloxane-co-(3-aminopropyl) methyl siloxane/3-ammoniopropyl) methyl siloxane nonafluoropentanoate], which exhibited utility in image fixation and enhancement of image quality similar to that exhibited by poly[dimethylsiloxane-co-(3-aminopropyl) methyl siloxane/3-ammoniopropyl) methylsiloxane triflate].

Preparatlon of Fixing Fluid A

To facilitate the controlled deposition of this fixing fluid using an apparatus analogous to that described in FIG. 1, poly[dimethylsiloxane-co-(3-aminopropyl)methyl siloxane/3-ammoniopropyl)methyl siloxane triflate] prepared as described above was diluted by 20 percent with octanol to yield a fluid containing 80 percent by weight of poly [dimethylsiloxane-co-(3-aminopropyl)methyl siloxane/3-ammoniopropyl) methyl siloxane triflate] and having a viscosity of about 240 centipoise.

EXAMPLE II

Preparation of Poly[dimethylsiloxane-co-(3-Trimethylammoniopropyl)methyl Siloxane Tosylate]

Poly[dimethylsiloxane-co-(3-trimethylammoniopropyl) methyl siloxane tosylate] was prepared by quaternization of poly[dimethylsiloxane-co-(3-aminopropyl) methyl siloxane] (GP-4 silicone fluid, obtained from Genesee Polymers Corporation, Flint Mich.) with methyl-p-toluene sulfonate in methylene chloride. Thus, 123.5 grams (0.025 moles) of GP-4, 30 grams (0.15 moles)of a 65 percent by weight aqueous $NaHCO_3$ solution, and 123 grams of $CH_2Cl_2$ were charged to a 1 liter 3-necked round bottomed flask fitted with an air stirrer, argon purge, pressure equalizing addition funnel, condenser, and thermometer. The reaction mixture was cooled with an ice bath to maintain the temperature at 18 to 22° C. throughout the addition, over a period of 30 minutes, of 28 grams of a 50 percent by weight solution of p-methyltoluenesulfonate in $CH_2Cl_2$. When the addition of p-methyltoluenesulfonate was complete, stirring was continued and the ice bath was removed. The system was stirred for 3 hours, allowing the reaction mixture to equilibrate at ambient temperature. A white solid, probably a mixture of sodium bicarbonate and sodium tosylate, separated from the reaction mixture. The reaction mixture was then diluted with additional methylene chloride and the insoluble material was removed by filtration. The methylene chloride solution was extracted with deionized water to remove sodium tosylate from the product, and dried over anhydrous MgSO4. Removal of the methylene chloride in vacuo yielded the desired product.

Preparation of Fixing Fluid B

To facilitate the controlled deposition of this fixing fluid using a apparatus analogous to that described in FIG. 1, poly[dimethylsiloxane-co-(3-trimethylammoniopropyl) methyl siloxane tosylate] prepared as described above was diluted by 200 percent with a low viscosity ethoxy-terminated siloxane oil (PS-393, obtained from Petrach Chemical) to yield a fluid containing 33 percent by weight of poly[dimethylsiloxane-co-(3-trimethylammoniopropyl) methyl siloxane tosylate] and having a viscosity of about 55 centipoise.

EXAMPLE III

Preparation of poly[dimethylsiloxane-co-(3-Aminopropyl)Methyl Siloxane/3-Ammoniopropyl) Methyl Siloxane Camphor Sulonate]

Poly[dimethylsiloxane-co-(3-aminopropyl)methyl siloxane/3-ammoniopropyl) methyl siloxane camphor sulfonate] was prepared by fractionally neutralizing poly [dimethylsiloxane-co-(3-aminopropyl)methyl siloxane] (GP-4 silicone fluid, obtained from Genesee Polymers Corporation, Flint Mich.) with camphor sulfonic acid. Thus, 90.5 grams (0.0736 equivalents) of GP-4 silicone fluid and 12.8 grams (0.055 equivalents) of camphor sulfonic acid dissolved in 10 milliliters of ethanol were combined and mixed in a 250 milliliter round bottomed flask to yield a clear colorless liquid. Ethanol was removed in vacuo to yield the desired product.

Via procedures analogous to that described above, camphor sulfonic acid was reacted with poly[dimethylsiloxane-co-(6 -amino-3-azahexyl)methyl siloxanes (GP-316 and GP344, obtained from Genesee Polymers Corporation, Flint Ml). The resultant fixing fluids, subsequently referred to as GP316/CSA and GP344/CSA, exhibited utility in image fixation and enhancement of image quality similar to that exhibited by poly[dimethylsiloxane-co-(3-aminopropyl) methyl siloxane/3-ammoniopropyl) methyl siloxane camphor sulfonate].

Preparation of Fixing Fluid C

To facilitate the controlled deposition of this fixing fluid using an apparatus analogous to that described in FIG. 1, poly[dimethylsiloxane-co-(3-aminopropyl) methyl siloxane/3-ammoniopropyl) methyl siloxane camphor sulfonatel was diluted by 35 percent with a low viscosity ethoxy-terminated siloxane oil (PS-393, obtained from Petrach Chemical) to yield a fluid containing 65 percent by weight of poly[dimethylsiloxane-co-(3-aminopropyl)methyl siloxane/3-ammoniopropyl) methyl siloxane camphor sulfonate] and having a viscosity of about 415 centipoise.

EXAMPLE IV

Preparation of Poly[dmethylsiloxane-co-(3-Aminopropyl)Methyl Siloxane/3-Ammoniopropy] methyl Siloxane Phosphotunastate]

Poly[dimethylsiloxane-co-(3-aminopropyl) methyl siloxane/3-ammoniopropyl) methyl siloxane phosphotungstate] was prepared by fractionally neutralizing poly[dimethylsiloxane-co-(3-aminopropyl)methyl siloxane] (GP-4 silicone fluid, obtained from Genesee Polymers Corporation, Flint Mich.) with phosphotungstic acid. Thus, 24 grams ($4.87\times10^{-3}$ moles) of GP-4 silicone fluid and 3.51 grams ($1.22\times10^{-3}$ moles) of phosphotungstic acid (F.W.=2, 880) acid dissolved in 0.87 grams of methanol were combined and mixed in a 50 milliliter beaker to yield a clear hazy viscous liquid. Ethanol was removed in vocuo to yield the desired product.

Preparation of Fixing Fluid D

To facilitate the controlled deposition of this fixing fluid, poly[dimethylsiloxane-co-(3-aminopropyl) methyl siloxane/3-ammoniopropyl) methylsiloxane phosphotungstate] was diluted by 60 percent with a low viscosity ethoxy-terminated siloxane oil (PS-393, obtained from Petrarch Chemical) to yield a fluid containing 40 percent by weight of poly[dimethylsiloxane-co-(3-aminopropyl) methylsiloxane/3-ammoniopropyl) methylsiloxane phosphotungstate.

EXAMPLE V

Preparation of Fixing Fluid E, poly [dimethylsiloxane-co-(3-Hydroxypropyl) Methylsiloxane]-Graft-[Poly(Ethylene Glycol)]/ Guanidium Hydrochloride Complex Poly[dimethylsiloxane-co-(3-hydroxypropyl) methylsiloxane]-graft-[poly(ethylene glycol)]/guanidium hydrochloride complex was prepared by dissolution of guanidine hydrochloride in poly[dimethylsiloxane-co-(3-hydroxypropyl) methyl siloxane]-graft-[poly(ethylene glycol] (DBE-224, obtained from Gelest, Inc., Tullytown, Pa.). Thus, 10 grams (0.057 equivalents) of DBE-224 and 1.08 grams (0.011 equivalents) of guanidine hydrochloride dissolved in 3.36 grams of methanol were combined and mixed in a 50 milliliter beaker to yield a clear colorless liquid. Methanol was removed in vacuo to yield the desired product.

EXAMPLE VI

Preparation of Poly[dimethylsiloxane-co-methyl (3-Hydroxypropyl]siloxane]-Graft-[Poly(Ethylene Glycol)]/Phosphomolybdic Acid Complex Poly[dimethylsiloxane-co-(3-hydroxypropyl) methylsiloxane]-graft-[poly(ethylene glycol)]/ phosphomolybdic acid complex was prepared by reacting phosphomolybdic acid with poly[dimethylsiloxane-co-(3-hydroxypropyl) methyl siloxane]-graft-[poly(ethylene glycol] (Tegopren 5842, obtained from Goldschmidt Chemical, Hopewell, Va.). Thus, 15 grams (0.0134 equivalents) of Tegopren 5842 and 14.7 grams ($8.05\times10^{-3}$ moles) of phosphomolybdic acid dissolved in 3.7 grams of methanol were combined and mixed in a 50 milliliter beaker to yield a viscous liquid. Methanol was removed in vacuo to yield the desired product.

In a preferred embodiment, it is preferred to neutralize the above material with $8.05\times10^{-3}$ moles of tetramethylammonium hydroxide to stabilize the material and to prevent slow degradation of the siloxane polymer by the acid.

Preparation of Fixing Fluid F

To facilitate the controlled deposition of this fixing fluid, poly [dimethylsiloxane-co-(3-hydroxypropyl) methylsiloxane]-graft-[poly(ethylene glycol)]/ phosphomolybdic acid complex was diluted by 33% with tripropylene glycol monomethyl ether (DOWANOL TPM, obtained from Dow Chemical Co., Midland, Mich.) to yield a fluid containing 67 percent by weight of poly [dimethylsiloxane-co-(3-hydroxypropyl) methylsiloxane]-graft-[poly(ethylene glycol)]/phosphomolybdic acid complex.

EXAMPLE VII

Preparation of Poly[dimethylsiloxane-co-methyl(3-hydroxypropyl)Siloxane]-Graft-[polyethylene Glycol]/$MaCl_6$ Complex Poly[dimethylsiloxane-co-(3-hydroxypropyl) methylsiloxane]-graft-[poly(ethylene glycol)]/$MgCl_2$ complex was prepared by reacting $MgCl_2$ with poly [dimethylsiloxane-co-(3-hydroxypropyl) methyl siloxane]-graft-[poly(ethylene glycol] (Tegopren 5842, obtained from Goldschmidt Chemical, Hopewell, Va.). Thus, 10 grams ($8.92\times10^{-3}$ equivalents) of Tegopren 5842 and 0.51 grams ($5.35\times10^{-3}$ moles) of $MgCl_2$ dissolved in 1.04 grams of water were combined and mixed in a 50 milliliter beaker to yield a viscous liquid.

Via procedures analogous to that described above, $CaCl_2$, $SrCl_2$, $BaCl_2$, $MnCl_2$, $CdCl_2$, RbCl, CsCl, aluminum triflate, sodium tetraborate, and zirconium(IV) citrate-ammonium complex were each reacted with poly[dimethylsiloxane-co-(3-hydroxypropyl)methylsiloxane]-graft-[poly(ethylene glycol] to yield poly[dimethylsiloxane-co-(3-hydroxypropyl)methylsiloxane]-graft-[poly(ethylene glycol)]/salt complexes. These fixing fluids exhibited utility in image fixation and enhancement of image quality similar to that exhibited by the poly[dimethylsiloxane-co-(3-hydroxypropyl) methylsiloxane]-graft-[poly (ethylene glycol)]/$MgCl_2$ complex].

Preparation of Fixing Fluid G

To facilitate the controlled deposition of this fixing fluid, poly[dimethylsiloxane-co-(3-hydroxypropyl) methylsiloxane] -graft-[poly(ethylene glycol)]/$MgCl_2$ complex was diluted by 33 percent with dipropylene glycol dibenzoate to yield a fluid containing 67 percent by weight of poly[dimethylsiloxane-co-(3-hydroxypropyl) methylsiloxane]-graft-[poly(ethylene glycol)]/$MgCl_2$.

EXAMPLE VIII

Preparation of Fixing Fluid H, Poly [dimethylsiloxane-co-methyl(3-carboxypropyl) Siloxane]

Poly[dimethylsiloxane-co-methyl(3-carboxypropyl) siloxane] was prepared by hydrosilylation of the trimethylsilylester of vinylacetic acid catalyzed by platinum divinyltetramethyl disiloxane complex (SIP 6831.0, obtained from Gelest, Inc., Tullytown Pa.). After hydrosilylation, the trimethylsilylester was hydrolyzed to give the desired product. Thus, 19.8 grams (0.05 equivalents) of poly [dimethylsiloxane-co-methyl hydrogen siloxane] containing 15 to 18 mole percent [MeHSiO] (HMS 151, obtained from Gelest, Inc., Tullytown, Pa.), 7.81 grams (0.055 equivalents) of trimethylsilyl vinyl acetic acid, and 28 grams of methylene chloride were charged to a 50 milliliter bottle equipped with a magnetic stirring bar. The solution was purged with argon for 15 minutes prior to the introduction of 4 drops of SIP 6831.0. The reaction was allowed to proceed for 4 days at ambient temperature. At this time the reaction was judged to be complete on the basis of the disappearance of the characteristic Si-H infrared band at 2160–2180 $cm^{-1}$. Water was then added to the reaction mixture, and hydrolysis was effected by heating the mixture on a steam cone. The water and methylene chloride layers were separated in a separatory funnel and the water layer was exhaustively extracted with methylene chloride. Methylene chloride extracts were combined and dried over anhydrous $MgSO_4$. Removal of methylene chloride in vacuo yielded poly[dimethylsiloxane-co-methyl(3-carboxypropyl)siloxane] containing 15 to 18 mole percent of carboxypropyl groups.

Analogous reactions employing poly[dimethylsiloxane-co-methyl hydrogen siloxane]s containing 3 to 4, 6 to 7, and 25 to 30 mole percent [MeHSiO] yielded the corresponding poly[dimethylsiloxane-co-methyl(3-carboxypropyl) siloxane]s containing 3 to 4, 6 to 7 and 25 to 30 mole percent carboxypropyl groups, respectively. The effectiveness of these fixing fluids in providing enhanced image fix scaled with their content of carboxypropyl groups, with those having more carboxypropyl groups being more effective. Effectiveness in enhancement of image quality (edge acuity and intercolor bleed and image density) was comparable across the series.

Preparation of the Trimethylsilyl Ester of Vinvl Acetic Acid

The trimethylsilyl ester of vinyl acetic acid was prepared by reaction of vinyl acetic acid and hexamethyldisilazane. Thus, 11.5 grams (0.133 moles) of vinyl acetic acid (obtained from Aldrich Chemical Co.) was charged to a 100 milliliter round bottomed flask fitted with a condenser, argon purge, rubber serum cap, and magnetic stirring bar. After purging for about 15 minutes, 11.8 grams (0.73 moles) of hexamethyldisilazane (obtained from Aldrich Chemical Co.) was added through the serum cap via syringe. The reaction mixture exothermed, and vigorous outgassing was observed for 15 to 20 minutes. A drop of concentrated sulfuric acid was then added and the reaction mixture was refluxed for 2 hours to drive the reaction to completion. The flask was then fitted with a vacuum jacketed Vigreux column, distillation head, and condenser with fraction cutter. Product which distilled over at 138 to 143° C. was used in subsequent hydrosilylation reactions.

EXAMPLE IX

Preparation of Fixing Fluid J, Poly [dimethylsiloxane-co-methyl(3-carboxyproyl) Siloxane]/$MgCl_2$ Complex Poly[dimethylsiloxane-co-methyl (3-carboxypropyl) siloxane]/$MgCl_2$ complex was prepared by reacting $MgCl_2$ with the poly[dimethyl siloxane-co-methyl (3-carboxypropyl)siloxane prepared in Example V. Thus, 10 grams ($8.92\times10^{-3}$ equivalents) of poly[dimethylsiloxane-co-methyl(3-carboxypropyl)siloxane and 0.30 grams ($1.48\times10^{-3}$ moles) of magnesium chloride hexahydrate dissolved in 1.04 grams of water were combined and mixed in a 50 milliliter beaker to yield a viscous liquid.

EXAMPLE X

Substrate Modification and Print Tests

Fixing fluids (including some of those prepared in Examples I to IX) were loaded in the sump of an apparatus analogous to that shown in FIG. 1, and Xerox® Image series paper was passed through the apparatus to deposit uniformly amounts of fixing fluid ranging in most instances from 10 to 200 microliters per page. The amount of fixing fluid deposited was controlled by varying the number of passes through the apparatus. Substrates were treated with fixing fluid both before and after deposition of ink jet images. The tables below display wet smear data from test patterns printed on treated and untreated papers. Printing was carried out using a Xerox® XJ4C ink jet printer. The inks used for printing had the following compositions:

Black: 5 percent by weight Direct Red 227 dye solution (containing 10 percent by weight dye solids, obtained from Tricon Colors), 16.75 percent by weight Basacid X-34 dye solution (containing 34 percent by weight dye solids, obtained from BASF), 11 percent by weight tripropylene glycol monomethyl ether (DOWANOL TPM, obtained from Dow Chemical Co.), 10 percent by weight dipropylene glycol, 0.65 percent by weight tris(hydroxymethyl) aminomethane, 0.35 percent by weight EDTA, 0.10 percent by weight DOWICIL 200 biocide (obtained from Dow Chemical Co.), 0.05 percent by weight polyethylene oxide (glycidyl bisphenol-A derivative, molecular weight 18,500, obtained from Polysciences), and 56.10 percent by weight deionized water.

Cyan: 35 percent by weight Projet Cyan 1 dye solution (containing 10 percent by weight Direct Blue 199 dye solids, obtained from Zeneca Colors), 11 percent by weight tripropylene glycol monomethyl ether (DOWANOL TPM, obtained from Dow Chemical Co.), 10 percent by weight dipropylene glycol, 0.65 percent by weight tris (hydroxymethyl) aminomethane, 0.35 percent by weight EDTA, 0.10 percent by weight DOWICIL 200 biocide (obtained from Dow Chemical Co.), 0.05 percent by weight polyethylene oxide (glycidyl bisphenol-A derivative, molecular weight 18,500, obtained from Polysciences), and 42.85 percent by weight deionized water.

Magenta: 5 percent by weight Acid Red 52 dye, 25 percent by weight Projet Magenta 1 T dye solution (containing 10.5 percent by weight dye solids, obtained from Zeneca Colors), 11 percent by weight tripropylene glycol monomethyl ether (DOWANOL TPM, obtained from Dow Chemical Co.), 10 percent by weight dipropylene glycol, 0.65 percent by weight tris(hydroxymethyl) aminomethane, 0.35 percent by weight EDTA, 0.10 percent by weight DOWICIL 200 biocide (obtained from Dow Chemical Co.), 0.05 percent by weight polyethylene oxide (glycidyl bisphenol-A derivative, molecular weight 18,500, obtained from Polysciences), and 47.85 percent by weight deionized water.

One measure of image quality and permanence is the resistance of the printed image to wet smear. The wet smear evaluation is designed to measure the permanence of an image with regard to its susceptibility to being smeared by the action of a wet, dynamic, abrasive physical contact (such as a wetted thumb dragged across the image, "wet thumb test"). The test pattern used for the wet smear test was a set of 22 lines of a specific ink 50 millimeters in length and 1.2 millimeters in thickness, with the lines separated by a distance of 6 millimeters. This pattern was printed and "aged" for a specified time (e.g., 1 day but no longer than 4 days) before wet smear testing. A felt wick [Dri Mark Products Market parts: Filler (part# 600F) and Wide Chisel Tip Nib (part # 600N)] was prewetted with distilled water and inserted into the pen of the wet smear testing apparatus. The assembly was then lowered until it contacted the surface of a white plastic strip with a 100 grams mass loading. The pen was then set in motion across the line pattern on a test document. The process was repeated with virgin felt pens across different segments of the test pattern. The paper was then removed and the optical density of the smeared areas (between the lines) was measured with a densitometer, X-Rite 428, or equivalent. Optical density was measured in at least four locations along the wet smear path (in the middle of the swath immediately following the 6th, 10th, 14th, and 18th bands on the document, for the first and second wet smear swaths). The average O.D. in the smear transfer area from the 8 measurements was recorded, and the background O.D was subtracted to give the "smear OD", average smear (minus background).

The following table contains the data for the Xerox® Image Series paper pretreated with the indicated fixing fluid and subsequently printed with the indicated color ink (with the control being untreated Xerox® Image Series Paper):

| Substrate | Black Smear OD | Cyan Smear OD | Magenta Smear OD |
|---|---|---|---|
| control | 0.087 ± 0.014 | 0.090 ± 0.019 | 0.037 ± 0.013 |
| GP4 @ 140 μL/page | 0.061 ± 0.008 | 0.054 ± 0.011 | 0.021 ± 0.008 |
| GP4 @ 290 μL/page | 0.047 ± 0.005 | 0.045 ± 0.007 | 0.020 ± 0.008 |
| fixing fluid C (GP4/CSA) @ 110 μL/page | 0.056 ± 0.005 | 0.074 ± 0.005 | 0.020 ± 0.000 |
| fixing fluid C (GP4/CSA) @ 240 μL/page | 0.041 ± 0.006 | 0.052 ± 0.005 | 0.021 ± 0.003 |

The data show significant reduction in wet smear for substrates pretreated with GP4 and with fixing fluid D (GP4/CSA).

The following table contains the data for the Xerox® Image Series paper printed with the indicated color ink and subsequently treated with the indicated fixing fluid (with the control being untreated Xerox® Image Series Paper):

| Substrate | Black Smear OD | Cyan Smear OD | Magenta Smear OD |
|---|---|---|---|
| control | 0.076 ± 0.005 | 0.090 ± 0.007 | 0.030 ± 0.000 |
| GP4 @ 50 μL/page | 0.069 ± 0.006 | 0.055 ± 0.014 | 0.024 ± 0.005 |
| GP316/CSA @ 30 μL/page | 0.031 ± 0.006 | 0.039 ± 0.003 | 0.017 ± 0.005 |
| fixing fluid C (GP4/CSA) @ 30 μL/page | 0.031 ± 0.006 | 0.020 ± 0.005 | 0.016 ± 0.005 |
| fixing fluid C (GP4/CSA) @ 140 μL/page | 0.004 ± 0.005 | 0.002 ± 0.005 | 0.000 ± 0.003 |
| fixing fluid E (DBE224/G-HCI) @ 70 μL/page | 0.042 ± 0.007 | 0.036 ± 0.007 | 0.009 ± 0.003 |

The data show dramatic reduction in wet smear for test patterns printed and subsequently treated with GP316/CSA, fixing Fluid E (DBE224/guanidinium hydrochloride) and fixing fluid C (GP4/CSA).

EXAMPLE XI

Substrate Modification and Print Tests

Prints were generated on Xerox® Image Series paper and wet smear was measured by the process of Example X except that the prints were made on a Hewlett-Packard 1600C ink jet printer with the heater disabled and that the inks used had the following compositions:

Black: 2.5 percent by weight carbon black dispersion (IJX-55, obtained from Cabot Corp., containing 16.2 percent by weight carbon black), 4.24 percent by weight acrylic latex (containing 35 percent by weight polymer solids, emulsion polymer latex containing benzyl methacrylate/ethyl methacrylate/methacrylic acid 55/21/24), 6 percent by weight 2-pyrrolidinone, 23.2 percent by weight sulfolane (containing 5 percent by weight water), 0.05 percent by weight polyethylene oxide (glycidyl bisphenol-A derivative, molecular weight 18,500, obtained from Polysciences), and 51.08 percent by weight deionized water.

Cyan: 22 percent by weight Projet Cyan 1 dye solution (containing 10 percent by weight Direct Blue 199 dye solids, obtained from Zeneca Colors), 21.43 percent by weight PROJET BLUE OAM dye solution (containing 10 percent by weight Acid Blue 9 dye solids, obtained from Zeneca Colors), 18 percent by weight tripropylene glycol monomethyl ether (DOWANOL TPM, obtained from Dow Chemical Co.), 21 percent by weight sulfolane (containing 5 percent by weight water), 0.65 percent by weight tris (hydroxymethyl) aminomethane, 0.35 percent by weight EDTA, 0.10 percent by weight DOWICIL 200 biocide (obtained from Dow Chemical Co.), 0.05 percent by weight polyethylene oxide (glycidyl bisphenol-A derivative, molecular weight 18,500, obtained from Polysciences), and 15.92 percent by weight deionized water.

Magenta: 8.95 percent by weight PROJET RED OAM dye solution (containing 10 percent by weight dye solids, obtained from Zeneca Colors), 41.05 percent by weight Projet Magenta 1 T dye solution (containing 10.5 percent by weight dye solids, obtained from Zeneca Colors), 18 percent by weight tripropylene glycol monomethyl ether (DOWANOL TPM, obtained from Dow Chemical Co.), 21 percent by weight sulfolane (containing 5 percent by weight water), 0.65 percent by weight tris(hydroxymethyl) aminomethane, 0.35 percent by weight EDTA, 0.10 percent by weight DOWICIL 200 biocide (obtained from Dow Chemical Co.), 0.05 percent by weight polyethylene oxide (glycidyl bisphenol-A derivative, molecular weight 18,500, obtained from Polysciences), and 15.92 percent by weight deionized water.

The following table contains the data for the Xerox® Image Series paper printed with the indicated color ink and subsequently treated with the indicated fixing fluid (with the control being untreated Xerox® Image Series Paper):

| Substrate | Black Smear OD | Cyan Smear OD | Magenta Smear OD |
|---|---|---|---|
| control | 0.062 ± 0.007 | 0.089 ± 0.006 | 0.062 ± 0.005 |
| GP344/CSA @ 60 μL/page | 0.007 ± 0.005 | 0.044 ± 0.009 | 0.036 ± 0.005 |
| fixing fluid B (GP4-quat) @ 40 μL/page | 0.007 ± 0.005 | 0.051 ± 0.006 | 0.077 ± 0.028 |
| fixing fluid C (GP4/CSA) @ 100 μL/page | 0.016 ± 0.005 | 0.047 ± 0.027 | 0.020 ± 0.000 |

The data show dramatic reduction in wet smear for black test patterns printed and subsequently treated with GP344/

CSA, fixing fluid B (GP4-quat), and fixing fluid C (GP4/CSA). Reduction in wet smear for cyan and magenta test patterns printed and subsequently treated with GP344/CSA, fixing fluid B (GP4-quat) and fixing fluid C (GP4/CSA) were also significant.

EXAMPLE XII

Measurement of Edge Acuity and Intercolor Bleed

Edge acuity (MFLEN) and intercolor bleed are related measures which can characterize the quality and the resolution of printed images. MFLEN and intercolor bleed were evaluated by measuring the deviation of line edges in a "tiger stripe" test pattern from a straight line. MFLEN measures the visual effect of the deviations of a line edge from a straight line. Raggedness quantifies the visual effects of variations in line width. Data was captured using a scanning microdensitometer. The microdensitometer was scanned along the length of a line and the amount of light reflected from the image area was measured and recorded. The data sets from the scans were converted from reflectance values to line widths using measured reflectance values for the printed (line) areas and the background areas. The line width data sets were then run through a Fast Fourier Transform routine to obtain a power spectrum (amplitude versus spatial frequency) for the line widths. The power spectra from the set of scans were averaged, and a frequency-dependent threshold value was subtracted from the amplitude computed for each frequency. If the results of these subtractions was positive, the differences were multiplied by a frequency-dependent sensitivity factor and the product was cubed. The cubed values were summed and the cube-root of the sum was calculated. This cube-root was a measure of raggedness and was reported as the MFLEN for lines printed directly on the substrate and as intercolor bleed for lines printed over a solid area of another color.

Edge acuity and intercolor bleed of images tends to be worst on inexpensive unfilled papers and recycled papers, such as Fuji Xerox L. The table below shows comparative measures of edge acuity (Black MFLEN) and intercolor bleed (Black/Yellow ICB) for "tiger stripe" test patterns printed on Fuji Xerox L paper before (control) and after treatment of this paper with fixing fluid A of Example I. The test pattern was printed with a Xerox® Docuprint XJ4C ink jet printer. The black ink was that described hereinabove in Example X. The composition of the yellow ink was as follows: 20 percent by weight Projet Yellow IG dye solution (containing 7.5 percent by weight Direct Yellow 132 dye solids), obtained from Zeneca Colors), 11 percent by weight tripropylene glycol monomethyl ether (DOWANOL TPM, obtained from Dow Chemical Co.), 10 percent by weight dipropylene glycol, 0.65 percent by weight tris (hydroxymethyl) aminomethane, 0.35 percent by weight EDTA, 0.10 percent by weight DOWICIL 200 biocide (obtained from Dow Chemical Co.), 0.05 percent by weight polyethylene oxide glycidyl bisphenol-A derivative, molecular weight 18,500, obtained from Polysciences), and 42.85 percent by weight deionized water.

| Substrate | Black MFLEN | Black/Yellow ICB |
|---|---|---|
| control | 34 ± 13 | 42.5 ± 17 |
| fixing fluid A @ 100 μL/page | 25 ± 9 | 32 ± 8 |

The data demonstrate a dramatic 25 percent improvement in MFLEN and intercolor bleed for the paper pretreated with fixing fluid A.

Other embodiments and modifications of the present invention may occur to those of ordinary skill in the art subsequent to a review of the information presented herein; these embodiments and modifications, as well as equivalents thereof, are also included within the scope of this invention.

What is claimed is:

1. A fluid deposition apparatus comprising (a) a fluid supply, (b) a porous fluid distribution member in operative connection with the fluid supply, enabling wetting of the fluid distribution member with a fluid, and (c) a porous metering membrane situated on the fluid distribution member, whereby the metering membrane enables uniform metering of the fluid from the fluid distribution member onto a substrate.

2. A fluid deposition apparatus according to claim 1 wherein the fluid supply comprises a fluid transporting structure in operative connection with the fluid distribution member, enabling wetting of the fluid distribution member from an external fluid supply.

3. A fluid deposition apparatus according to claim 1 wherein the fluid supply comprises at least one fluid reservoir in operative connection with the fluid distribution member, enabling wetting of the fluid distribution member from the fluid contained in the fluid reservoir.

4. A fluid deposition apparatus according to claim 1 wherein the fluid distribution member is a pad which is stationary with respect to the metering membrane and the fluid supply, and moves relative to the substrate to distribute fluid thereon.

5. A fluid deposition apparatus according to claim 1 wherein the fluid distribution member is a roller which is stationary with respect to the metering membrane, and wherein the fluid distribution member and the metering membrane rotate with respect to the fluid supply and roll across the substrate to distribute fluid thereon.

6. A fluid deposition apparatus according to claim I wherein the fluid distribution member comprises a polyurethane foam.

7. An apparatus comprising (a) a substrate supply, (b) a fluid deposition apparatus comprising (1) a fluid supply (2) a porous fluid distribution member in operative connection with the fluid supply, enabling wetting of the fluid distribution member with a fluid, and (3) a porous metering membrane situated on the fluid distribution member, whereby the metering membrane enables uniform metering of the fluid from the fluid distribution member onto a substrate; (c) an ink jet printer for placing marks on the substrate in an image configuration; and (d) a substrate advancing system in operative relationship with the ink jet printer and the fluid deposition apparatus, whereby the substrate is advanced from the substrate supply to the fluid deposition apparatus and the ink jet printer.

8. A printing apparatus according to claim 7 wherein the fluid supply comprises a fluid transporting structure in operative connection with the fluid distribution member, enabling wetting of the fluid distribution member from an external fluid supply.

9. A printing apparatus according to claim 7 wherein the fluid supply comprises at least one fluid reservoir in operative connection with the fluid distribution member, enabling wetting of the fluid distribution member from the fluid contained in the fluid reservoir.

10. A printing apparatus according to claim 7 wherein the fluid distribution member is a pad which is stationary with respect to the metering membrane and the fluid supply, and moves relative to the substrate to distribute fluid thereon.

11. A printing apparatus according to claim 7 wherein the fluid distribution member is a roller which is stationary with respect to the metering membrane, and wherein the fluid distribution member and the metering membrane rotate with respect to the fluid supply and roll across the substrate to distribute fluid thereon.

12. A printing apparatus according to claim 7 wherein the substrate advancing system advances the substrate to the ink jet printer before advancing the substrate to the fluid deposition apparatus.

13. A printing apparatus according to claim 7 wherein the substrate advancing system advances the substrate to the fluid deposition apparatus before advancing the substrate to the ink jet printer.

14. A process which comprises (a) providing an apparatus comprising (1) a substrate supply; (2) a fluid deposition apparatus comprising (i) a fluid supply, (ii) a porous fluid distribution member in operative connection with the fluid supply, enabling wetting of the fluid distribution member with a fluid, and (iii) a porous metering membrane situated on the fluid distribution member, whereby the metering membrane enables uniform metering of the fluid from the fluid distribution member onto a substrate: (3) an ink let printer for placing marks on the substrate in an image configuration; and (4) a substrate advancing system in operative relationship with the ink jet printer and the fluid deposition apparatus, whereby the substrate is advanced from the substrate supply to the fluid deposition apparatus and the ink let printer; (b) incorporating a fluid into the fluid deposition apparatus; (c) incorporating into the printing apparatus an ink composition; (d) applying the fluid to the substrate with the fluid deposition apparatus; and (e) causing droplets of the ink composition to be ejected in an imagewise pattern onto the substrate.

15. A process according to claim 14 wherein the fluid is applied to the substrate prior to causing droplets of the ink composition to be ejected in the imagewise pattern onto the substrate.

16. A process according to claim 14 wherein droplets of the ink composition are caused to be ejected in the imagewise pattern onto the substrate before the fluid is applied to the substrate.

17. A process according to claim 14 wherein the fluid is a fixing fluid capable of interacting with a colorant in the ink to cause the colorant to become complexed, laked, or mordanted, and wherein the ink composition comprises water and the colorant which becomes complexed, laked, or mordanted upon contacting the fixing fluid.

18. A process according to claim 17 wherein the fixing fluid comprises a material selected from the group consisting of (1) block or graft copolymers of dialkylsiloxanes and polar, hydrophilic monomers capable of interacting with the ink colorant to cause the colorant to become complexed, laked, or mordanted, (2) organopolysiloxane copolymers having functional side groups capable of interacting the ink colorant to cause the colorant to become complexed, laked, or mordanted, (3) perfluorinated polyalkoxy polymers, (4) perfluoroalkyl surfactants having thereon at least one group capable of interacting with the ink colorant to cause the colorant to become complexed, laked, or mordanted, and (5) mixtures thereof.

19. A process according to claim 18 wherein the fixing fluid further comprises a complexing agent.

20. A process according to claim 19 wherein the complexing agent is selected from the group consisting of multivalent metal ions, ammonium ions, benzylammonium ions, alkylammonium ions, polyalkylammonium ions, heteropolyacids, isopolyacids and their salts, dicarboxylic acids, tricarboxylic acids, tetracarboxylic acids, boric acid, borate anions, tetraaryl boride anions, alkyl substituted aryl sulfonate anions, alkyl substituted phosphate anions, and mixtures thereof.

21. A process according to claim 17 wherein the colorant is an anionic dye or a cationic dye.

* * * * *